US007396102B2

(12) United States Patent
Nishihara

(10) Patent No.: US 7,396,102 B2
(45) Date of Patent: Jul. 8, 2008

(54) METHOD FOR INSPECTING LIQUID EJECTION, APPARATUS FOR INSPECTING LIQUID EJECTION, LIQUID EJECTING APPARATUS, INKJET PRINTER, AND COMPUTER-READABLE MEDIUM

(75) Inventor: Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 185 days.

(21) Appl. No.: 11/060,578

(22) Filed: Feb. 18, 2005

(65) Prior Publication Data

US 2005/0212844 A1 Sep. 29, 2005

(30) Foreign Application Priority Data

| | | |
|---|---|---|
| Feb. 19, 2004 | (JP) | 2004-043343 |
| Feb. 19, 2004 | (JP) | 2004-043344 |
| Jan. 19, 2005 | (JP) | 2005-011869 |
| Jan. 19, 2005 | (JP) | 2005-011870 |

(51) Int. Cl.
*B41J 29/393* (2006.01)

(52) U.S. Cl. ..... 347/19

(58) Field of Classification Search ..... 347/19, 347/14

See application file for complete search history.

(56) References Cited

U.S. PATENT DOCUMENTS

| | | | | |
|---|---|---|---|---|
| 5,325,112 | A | 6/1994 | Muto | |
| 2003/0156149 | A1 * | 8/2003 | Choi | 347/19 |
| 2004/0001134 | A1 * | 1/2004 | Nakazawa et al. | 347/101 |
| 2004/0056917 | A1 * | 3/2004 | Su et al. | 347/19 |

FOREIGN PATENT DOCUMENTS

| | | | |
|---|---|---|---|
| JP | 59-120464 | A | 7/1984 |
| JP | 60-070365 | A | 4/1985 |
| JP | 60-070367 | A | 4/1985 |
| JP | 5-246036 | A | 9/1993 |
| JP | 10-151754 | A | 6/1998 |
| JP | 2000-255067 | A | 9/2000 |
| JP | 2002-361863 | A | 12/2002 |

* cited by examiner

*Primary Examiner*—Lamson Nguyen
(74) *Attorney, Agent, or Firm*—Sughrue Mion, PLLC

(57) ABSTRACT

Ejection inspection of nozzles for a liquid such as ink is enabled to be carried out easily. A method for inspecting liquid ejection includes: a step of ejecting an electrically-charged liquid from a nozzle subjected to ejection inspection; and a step of determining that the liquid has been ejected if an induced current is produced by the liquid ejected from the nozzle in a sensing section provided in a state of non-contact to the nozzle, and determining that the liquid has not been ejected if the induced current is not produced in the sensing section.

24 Claims, 30 Drawing Sheets

METHOD FOR INSPECTING LIQUID EJECTION, APPARATUS FOR INSPECTING LIQUID EJECTION, LIQUID EJECTING APPARATUS, INKJET PRINTER, AND COMPUTER-READABLE MEDIUM

CROSS-REFERENCE TO RELATED APPLICATIONS

The present application claims priority upon Japanese Patent Application No. 2004-43343 and Japanese Patent Application No. 2004-43344 filed on Feb. 19, 2004, as well as Japanese Patent Application No. 2005-11869 and Japanese Patent Application No. 2005-11870 filed on Jan. 19, 2005, which are herein incorporated by reference.

BACKGROUND OF THE INVENTION

1. Field of the Invention

The present invention relates to methods for inspecting liquid ejection, apparatuses for inspecting liquid ejection, liquid ejecting apparatuses, inkjet printers, and computer-readable media that execute ejection inspection of a liquid from a nozzle.

2. Description of the Related Art

Inkjet printers that carry out printing by ejecting ink onto various media such as paper, cloth, and film, are known as an example of liquid ejecting apparatuses. These inkjet printers perform color printing by ejecting color inks such as cyan (C), magenta (M), yellow (Y), and black (K) to form dots on the medium. Ink ejection is carried out using nozzles.

However, with such inkjet printers, clogging can occur in the nozzles due to adherence of the ink for example, and the ink may not be ejected properly. When ink cannot be ejected properly from the nozzles, dots cannot be formed appropriately on the medium, and this results in the problem that an image will not be printed clearly. For this reason, it is necessary to inspect whether or not ink is being ejected properly by periodically inspecting nozzle ejection.

Accordingly, various methods for inspecting whether or not ink is being ejected properly from a nozzle have been proposed conventionally. Specifically, methods have been proposed such as inspection for ejection failure of an ink by detecting whether or not a laser beam is blocked by the ink ejected from the nozzle.

However, a large-scale laser irradiation device is necessary to irradiate the laser beam in such an inspecting method, and in addition to it being exceedingly difficult to secure space inside the printer for installing such a laser irradiation device, there is also the problem that this incurs greatly increased costs. For these reasons, there is an earnest desire for an ejection inspection apparatus that does not require much installation space, does not incur greatly increased costs, and is compact with a simpler structure.

SUMMARY OF THE INVENTION

The present invention has been devised in light of these circumstances, and it is an object thereof to enable ejection inspection of nozzles for a liquid such as ink to be carried out easily.

A primary aspect of the present invention is a method for inspecting liquid ejection such as the following.

A method for inspecting liquid ejection comprises:

a step of ejecting an electrically-charged liquid from a nozzle subjected to ejection inspection; and a step of determining that the liquid has been ejected if an induced current is produced by the liquid ejected from the nozzle in a sensing section provided in a state of non-contact to the nozzle, and determining that the liquid has not been ejected if the induced current is not produced in the sensing section.

Another primary aspect of the present invention is an apparatus for inspecting liquid ejection such as the following.

An apparatus for inspecting liquid ejection, comprises:

a sensing section provided in a state of non-contact to a nozzle subjected to ejection inspection; and a determination section for determining whether or not a liquid has been ejected from the nozzle, the determination section determining that the liquid has been ejected if an induced current is produced in the sensing section by the liquid that has been ejected from the nozzle and that has been electrically charged, and determining that the liquid has not been ejected if the induced current is not produced in the sensing section.

Another primary aspect of the present invention is a liquid ejecting apparatus such as the following.

A liquid ejecting apparatus, comprises:

a nozzle that ejects a liquid to a medium;

a sensing section provided in a state of non-contact to the nozzle; and a determination section for determining whether or not the liquid has been ejected from the nozzle, the determination section determining that the liquid has been ejected if an induced current is produced in the sensing section by the liquid that has been ejected from the nozzle and that has been electrically charged, and determining that the liquid has not been ejected if the induced current is not produced in the sensing section.

Another primary aspect of the present invention is an inkjet printer such as the following.

An inkjet printer, comprises:

a nozzle that ejects ink to a medium;

a sensing section provided in a state of non-contact to the nozzle; and a determination section for determining whether or not the ink has been ejected from the nozzle, the determination section determining that the ink has been ejected if an induced current is produced in the sensing section by the ink that has been ejected from the nozzle and that has been electrically charged, and determining that the ink has not been ejected if the induced current is not produced in the sensing section.

Another primary aspect of the present invention is a computer-readable medium such as the following.

A computer-readable medium for causing an apparatus for inspecting liquid ejection to operate, comprises:

a code for causing ejection of an electrically-charged liquid from a nozzle subjected to ejection inspection; and a code for determining that the liquid has been ejected if an induced current is produced, in a sensing section provided in a state of non-contact to the nozzle, by the liquid that has been ejected from the nozzle and that has been charged, and determining that the liquid has not been ejected if the induced current is not produced in the sensing section.

Another primary aspect of the present invention is a method for inspecting liquid ejection such as the following.

A method for inspecting liquid ejection comprises:

a step of ejecting an electrically-charged liquid from a nozzle subjected to ejection inspection; and a step of detecting an intensity of an induced current produced by the liquid ejected from the nozzle in a sensing section that is provided in a state of non-contact to the nozzle, and determining whether or not an ejection direction of the liquid is proper based on the intensity of the induced current that has been detected.

Another primary aspect of the present invention is an apparatus for inspecting liquid ejection such as the following.

An apparatus for inspecting liquid ejection, comprises:

a sensing section provided in a state of non-contact to a nozzle subjected to ejection inspection; and a determination section for determining whether or not an ejection direction of a liquid that has been ejected from the nozzle is proper, the determination section detecting an intensity of an induced current produced in the sensing section by the liquid that has been ejected from the nozzle and that has been electrically charged, and determining whether or not the ejection direction of the liquid is proper based on the intensity of the induced current that has been detected.

Another primary aspect of the present invention is a liquid ejecting apparatus such as the following.

A liquid ejecting apparatus, comprises:

a nozzle that ejects a liquid to a medium;

a sensing section provided in a state of non-contact to the nozzle; and a determination section for determining whether or not an ejection direction of the liquid from the nozzle is proper, the determination section detecting an intensity of an induced current produced in the sensing section by the liquid that has been ejected from the nozzle and that has been electrically charged, and determining whether or not the ejection direction of the liquid is proper based on the intensity of the induced current that has been detected.

Another primary aspect of the present invention is an inkjet printer such as the following.

An inkjet printer, comprises:

a nozzle that ejects ink to a medium;

a sensing section provided in a state of non-contact to the nozzle; and a determination section for determining whether or not an ejection direction of the liquid from the nozzle is proper, the determination section detecting an intensity of an induced current produced in the sensing section by the ink that has been ejected from the nozzle and that has been electrically charged, and determining whether or not the ejection direction of the ink is proper based on the intensity of the induced current that has been detected.

Another primary aspect of the present invention is a computer-readable medium such as the following.

A computer-readable medium for causing an apparatus for inspecting liquid ejection to operate, comprises:

a code for causing ejection of an electrically-charged liquid from a nozzle subjected to ejection inspection;

a code for detecting an intensity of an induced current produced by the liquid ejected from the nozzle in a sensing section that is provided in a state of non-contact to the nozzle; and a code for determining whether or not an ejection direction of the liquid is proper based on the intensity of the induced current that has been detected.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF PREFERRED EMBODIMENTS

Figure 1:
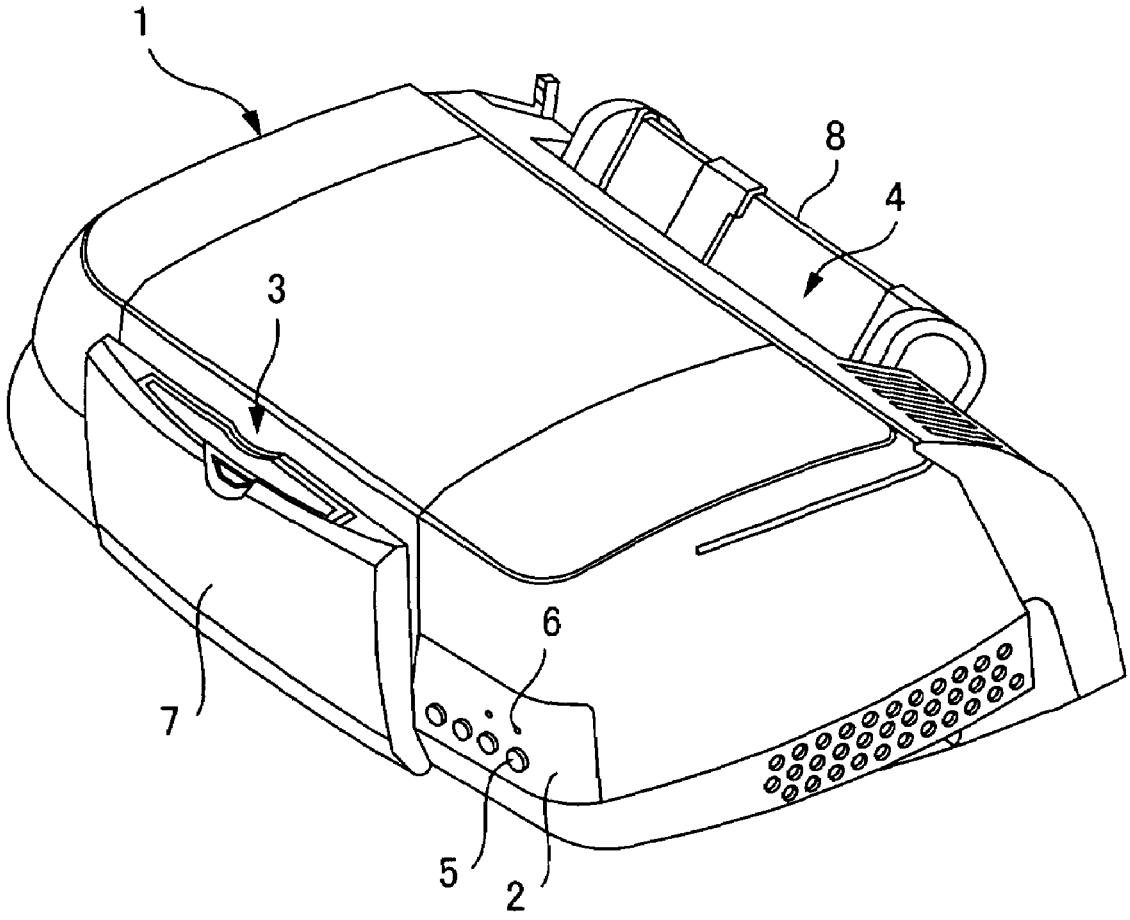
FIG. 1 is a perspective view of an inkjet printer.

At least the following matters will be made clear by the present specification and the accompanying drawings.

A method for inspecting liquid ejection comprises:

a step of ejecting an electrically-charged liquid from a nozzle subjected to ejection inspection; and a step of determining that the liquid has been ejected if an induced current is produced by the liquid ejected from the nozzle in a sensing section provided in a state of non-contact to the nozzle, and determining that the liquid has not been ejected if the induced current is not produced in the sensing section.

With this method for inspecting liquid ejection, it is possible to easily inspect whether or not the liquid has been ejected from the nozzle by detecting the induced current that is produced in the sensing section by the liquid, which is ejected from the nozzle and is charged.

In the present method for inspecting liquid ejection, it is preferable that a liquid droplet is ejected as the liquid from the nozzle subjected to ejection inspection.

With this method for inspecting liquid ejection, it is possible to reduce the amount of liquid used in ejection inspection by ejecting a liquid droplet from the nozzle.

In the present method for inspecting liquid ejection, it is preferable that the induced current produced in the sensing section is detected.

With this method for inspecting liquid ejection, it is possible to make a determination easily by detecting the induced current produced in the sensing section.

In the present method for inspecting liquid ejection, it is preferable that a determination of whether or not the induced current has been produced in the sensing section is carried out by comparing a current level of the induced current that has been detected and a predetermined reference level.

With this method for inspecting liquid ejection, it is possible to easily determine whether or not an induced current has been produced in the sensing section.

In the present method for inspecting liquid ejection, it is preferable that the liquid ejected from the nozzle is electrically charged by applying a voltage to the sensing section.

With this method for inspecting liquid ejection, it is possible to easily charge the liquid ejected from the nozzle by applying a voltage to the sensing section.

In the present method for inspecting liquid ejection, it is preferable that the liquid ejected from the nozzle is electrically charged by frictional electrification.

With this method for inspecting liquid ejection, it is possible to easily charge the liquid using frictional electrification.

In the present method for inspecting liquid ejection, it is preferable that the liquid ejected from the nozzle is electrically charged by an electrode section to which a voltage is applied.

With this method for inspecting liquid ejection, it is possible to easily charge the liquid that is ejected from the nozzle using the electrode section.

In the present method for inspecting liquid ejection, it is preferable that the sensing section is made of a wire material.

With this method for inspecting liquid ejection, it is possible to easily perform sensing of whether or not the liquid has been ejected from the nozzle.

In the present method for inspecting liquid ejection, it is preferable that the sensing section is formed in a coil shape.

With this method for inspecting liquid ejection, it is possible to perform sensing of the liquid ejected from the nozzle with greater sensitivity.

In the present method for inspecting liquid ejection, it is preferable that a water repellent treatment is applied to a surface of the sensing section.

With this method for inspecting liquid ejection, it is possible to reduce adhesion of the liquid to the surface of the sensing section.

In the present method for inspecting liquid ejection, it is preferable that the liquid ejected from the nozzle is ink.

With this method for inspecting liquid ejection, it is possible to easily carry out ejection inspection of the nozzle from which ink is ejected.

It is also possible to achieve an apparatus for inspecting liquid ejection such as the following.

An apparatus for inspecting liquid ejection, comprises:

a sensing section provided in a state of non-contact to a nozzle subjected to ejection inspection; and a determination section for determining whether or not a liquid has been ejected from the nozzle, the determination section determining that the liquid has been ejected if an induced current is produced in the sensing section by the liquid that has been ejected from the nozzle and that has been electrically charged, and determining that the liquid has not been ejected if the induced current is not produced in the sensing section.

It is also possible to achieve a liquid ejecting apparatus such as the following.

A liquid ejecting apparatus, comprises:

a nozzle that ejects a liquid to a medium;

a sensing section provided in a state of non-contact to the nozzle; and a determination section for determining whether or not the liquid has been ejected from the nozzle, the determination section determining that the liquid has been ejected if an induced current is produced in the sensing section by the liquid that has been ejected from the nozzle and that has been electrically charged, and determining that the liquid has not been ejected if the induced current is not produced in the sensing section.

It is also possible to achieve an inkjet printer such as the following.

An inkjet printer, comprises:

a nozzle that ejects ink to a medium;

a sensing section provided in a state of non-contact to the nozzle; and a determination section for determining whether or not the ink has been ejected from the nozzle, the determination section determining that the ink has been ejected if an induced current is produced in the sensing section by the ink that has been ejected from the nozzle and that has been electrically charged, and determining that the ink has not been ejected if the induced current is not produced in the sensing section.

It is also possible to achieve a computer-readable medium such as the following.

A computer-readable medium for causing an apparatus for inspecting liquid ejection to operate, comprises:

a code for causing ejection of an electrically-charged liquid from a nozzle subjected to ejection inspection; and a code for determining that the liquid has been ejected if an induced current is produced, in a sensing section provided in a state of non-contact to the nozzle, by the liquid that has been ejected from the nozzle and that has been charged, and determining that the liquid has not been ejected if the induced current is not produced in the sensing section.

It is also possible to achieve a method for inspecting liquid ejection such as the following.

A method for inspecting liquid ejection comprises:

a step of ejecting an electrically-charged liquid from a nozzle subjected to ejection inspection; and a step of detecting an intensity of an induced current produced by the liquid ejected from the nozzle in a sensing section that is provided in a state of non-contact to the nozzle, and determining whether or not an ejection direction of the liquid is proper based on the intensity of the induced current that has been detected.

With this method for inspecting liquid ejection, it is possible to easily inspect whether or not the ejection direction of the liquid is proper by detecting the intensity of the induced current produced in the sensing section by the liquid, which has been ejected from the nozzle and has been charged.

In the present method for inspecting liquid ejection, it is preferable that a liquid droplet is ejected as the liquid from the nozzle subjected to ejection inspection.

With this method for inspecting liquid ejection, it is possible to reduce the amount of liquid used in ejection inspection as much as possible by ejecting a liquid droplet.

In the present method for inspecting liquid ejection, it is preferable that the liquid ejected from the nozzle is electrically charged by applying a voltage to the sensing section.

With this method for inspecting liquid ejection, it is possible to easily charge the liquid that is ejected from the nozzle.

In the present method for inspecting liquid ejection, it is preferable that the liquid ejected from the nozzle is electrically charged by frictional electrification.

With this method for inspecting liquid ejection, it is possible to easily charge the liquid using frictional electrification.

In the present method for inspecting liquid ejection, it is preferable that the liquid ejected from the nozzle is electrically charged by an electrode section to which a voltage is applied.

With this method for inspecting liquid ejection, it is possible to easily charge the liquid that is ejected from the nozzle.

In the present method for inspecting liquid ejection, it is preferable that a determination is made as to whether or not the ejection direction of the liquid is proper by comparing the intensity of the induced current that has been detected and a predetermined threshold value.

With this method for inspecting liquid ejection, it is possible to easily determine whether or not the ejection direction of the liquid is proper by comparing the intensity of the induced current and the predetermined threshold value.

In the present method for inspecting liquid ejection, it is preferable that the sensing section is made of a wire material.

With this method for inspecting liquid ejection, it is possible to easily perform sensing of the liquid that is ejected from the nozzle.

In the present method for inspecting liquid ejection, it is preferable that the nozzle is provided so as to be able to move relatively with respect to the sensing section; and the wire material is arranged obliquely with respect to a movement direction of the nozzle.

With this method for inspecting liquid ejection, even when a displacement occurs in the ejection direction of the liquid in a direction that is perpendicular to the movement direction of the nozzle, it is possible to detect this displacement.

In the present method for inspecting liquid ejection, it is preferable that at least two of the wire materials are arranged in a non-parallel arrangement.

With this method for inspecting liquid ejection, it is possible to discriminate with greater accuracy whether or not the ejection direction of the liquid is proper.

In the present method for inspecting liquid ejection, it is preferable that an intensity of the induced current produced in each of the wire materials is detected separately, and a determination as to whether or not the ejection direction of the liquid is proper is made based on each of the induced current intensity that has been detected.

With this method for inspecting liquid ejection, it is possible to discriminate with greater accuracy whether or not the ejection direction of the liquid is proper.

In the present method for inspecting liquid ejection, it is preferable that the liquid ejected from the nozzle is ink.

With this method for inspecting liquid ejection, it is possible to easily inspect whether or not the direction of the ink ejected from the nozzle is proper.

It is also possible to achieve an apparatus for inspecting liquid ejection such as the following.

An apparatus for inspecting liquid ejection, comprises:

a sensing section provided in a state of non-contact to a nozzle subjected to ejection inspection; and a determination section for determining whether or not an ejection direction of a liquid that has been ejected from the nozzle is proper, the determination section detecting an intensity of an induced current produced in the sensing section by the liquid that has been ejected from the nozzle and that has been electrically charged, and determining whether or not the ejection direction of the liquid is proper based on the intensity of the induced current that has been detected.

It is also possible to achieve a liquid ejecting apparatus such as the following.

A liquid ejecting apparatus, comprises:

a nozzle that ejects a liquid to a medium;

a sensing section provided in a state of non-contact to the nozzle; and a determination section for determining whether or not an ejection direction of the liquid from the nozzle is proper, the determination section detecting an intensity of an induced current produced in the sensing section by the liquid that has been ejected from the nozzle and that has been electrically charged, and determining whether or not the ejection direction of the liquid is proper based on the intensity of the induced current that has been detected.

It is also possible to achieve an inkjet printer such as the following.

An inkjet printer, comprises:

a nozzle that ejects ink to a medium;

a sensing section provided in a state of non-contact to the nozzle; and a determination section for determining whether or not an ejection direction of the liquid from the nozzle is proper, the determination section detecting an intensity of an induced current produced in the sensing section by the ink that has been ejected from the nozzle and that has been electrically charged, and determining whether or not the ejection direction of the ink is proper based on the intensity of the induced current that has been detected.

It is also possible to achieve a computer-readable medium such as the following.

A computer-readable medium for causing an apparatus for inspecting liquid ejection to operate, comprises:

a code for causing ejection of an electrically-charged liquid from a nozzle subjected to ejection inspection;

a code for detecting an intensity of an induced current produced by the liquid ejected from the nozzle in a sensing section that is provided in a state of non-contact to the nozzle; and a code for determining whether or not an ejection direction of the liquid is proper based on the intensity of the induced current that has been detected.

Overview of the Liquid Ejecting Apparatus

An embodiment of a liquid ejecting apparatus according to the present invention is described next. Here, an inkjet printer serving as an example of a liquid ejecting apparatus according to the present invention is described.

<Liquid Ejecting Apparatus>

Figure 2:
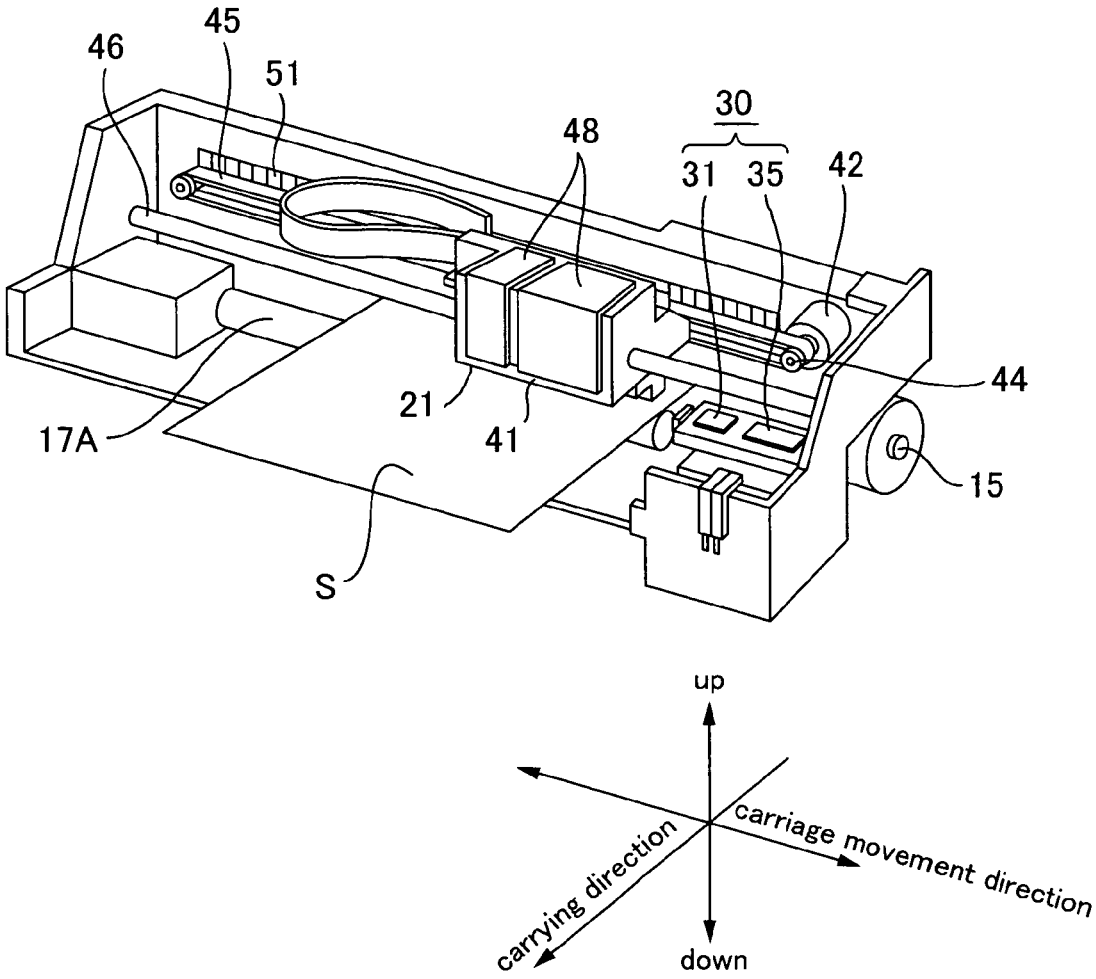
FIG. 2 shows the internal configuration of the inkjet printer.
Figure 3:
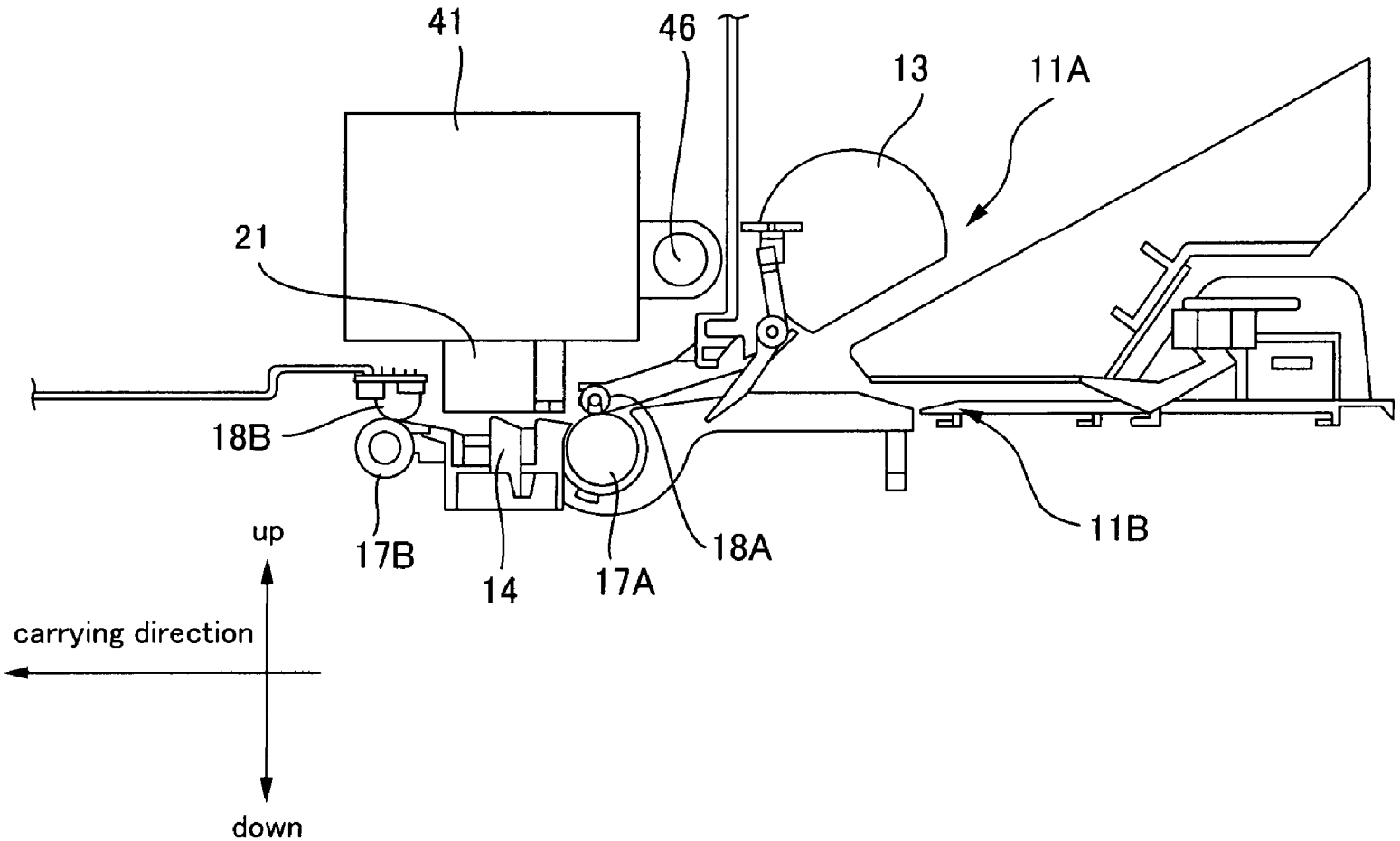
FIG. 3 is a cross sectional view of a carrying section of the inkjet printer.
Figure 4:
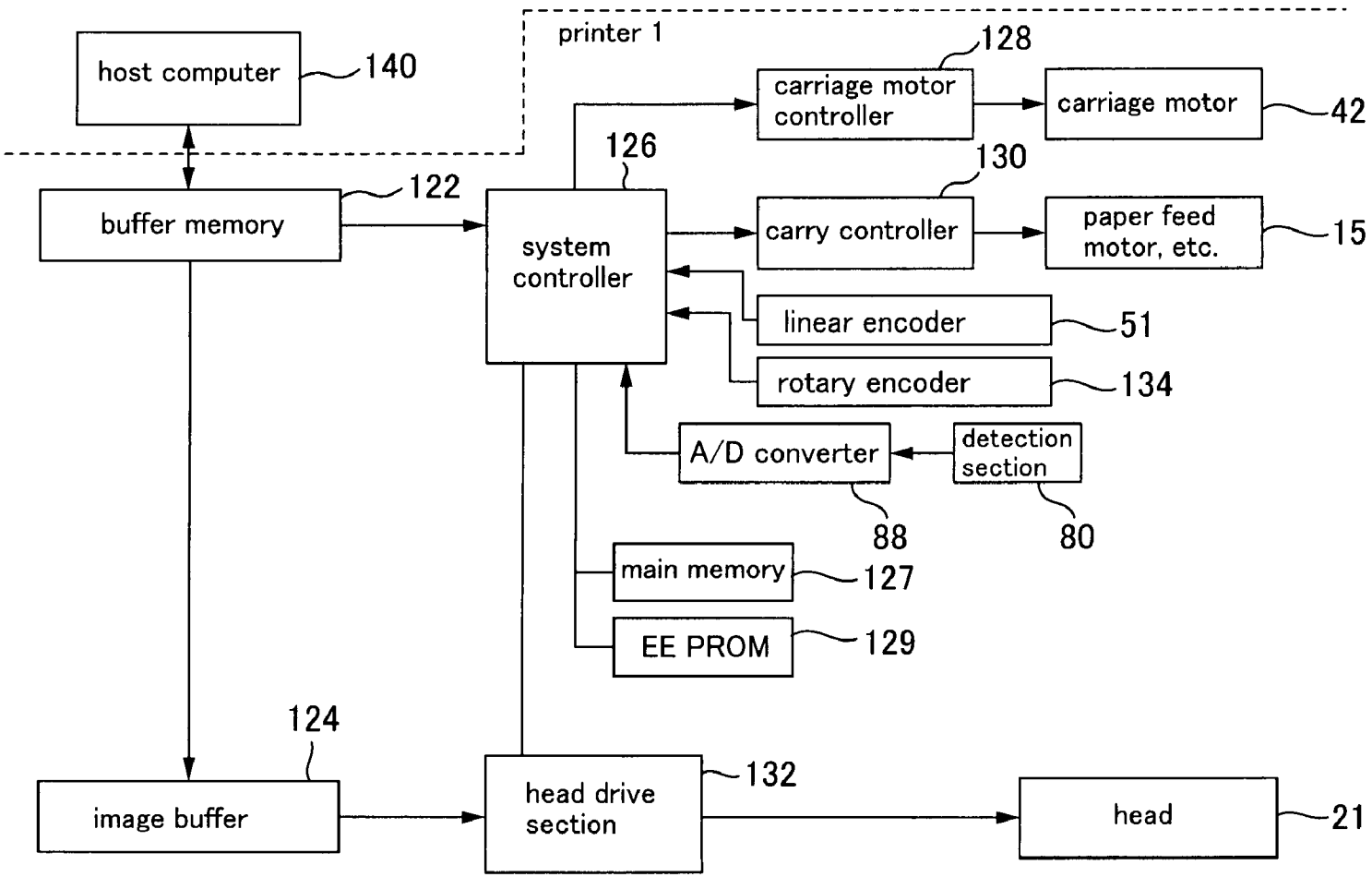
FIG. 4 is a block configuration diagram showing a system configuration of the inkjet printer.

FIGS. 1 to 4 show an inkjet printer 1. FIG. 1 shows an external view of the inkjet printer 1. FIG. 2 show the internal configuration of the inkjet printer 1. FIG. 3 shows the carrying section of the inkjet printer 1. FIG. 4 is a block configuration diagram showing the system configuration of the inkjet printer 1.

As shown in FIG. 1, the inkjet printer 1 is provided with a structure in which a medium such as print paper that is supplied from the rear side is discharged from the front side. A control panel 2 and a discharge section 3 are arranged at the front side and a paper supply section 4 is provided at the rear side. The control panel 2 is provided with various types of control buttons 5 and display lamps 6. The paper discharge section 3 is provided with a paper discharge tray 7 that blocks the paper discharge opening when the inkjet printer is not used. A paper supply tray 8 is arranged at the paper supply section 4 to hold cut paper (not shown). It should be noted that the inkjet printer 1 may be provided with a paper feed structure that is capable of being used to print not only print paper in single sheets, such as cut paper, but also media that are continuous, such as roll paper.

As shown in FIG. 2, a carriage 41 is arranged inside the inkjet printer 1. The carriage 41 is arranged such that it can move relatively along a predetermined direction (the left-and-right direction shown in the drawing in this embodiment). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a driving force for moving the carriage 41 relatively along the predetermined direction. Furthermore, the timing belt 45 is connected to the carriage motor 42 via the pulley 44 and a portion of it is also connected with the carriage 41, such that the carriage 41 is moved relatively along the predetermined direction by the rotational force of the carriage motor 42. The guide rail 46 guides the carriage 41 along the predetermined direction. In addition to these, a linear encoder 51 that detects the position of the carriage 41, a carry roller 17A for carrying a medium S in a direction that intersects the movement direction of the carriage 41, and a paper feed motor 15 that rotationally drives the carry roller 17A also are provided in the vicinity of the carriage 41.

On the other hand, ink cartridges 48 that contain various types of inks and a head 21 for executing printing with respect to the medium S are provided in the carriage 41. The ink cartridges 48 store color inks such as yellow (Y), magenta (M), cyan (C), and black (K) for example, and are mounted in a carriage mounting section provided in the carriage 41 so as to be removable. On the other hand, in this embodiment, the head 21 carries out printing by ejecting ink on the medium S. To do so, numerous nozzles for ejecting ink are provided in the head 21. Detailed description of the ink ejecting mechanism of the head 21 is provided later.

Additionally, a cleaning unit 30 for eliminating clogging of the nozzles of the head 21 is arranged inside the inkjet printer 1. The cleaning unit 30 has a pump device 31 and a capping device 35. The pump device 31 sucks out ink from the nozzles in order to eliminate clogging of the nozzles of the head 21, and is operated by a pump motor (not shown). On the other hand, the capping device 35 is for sealing the nozzles of the head 21 when printing is not being performed (during standby etc.) to keep the nozzles of the head 21 from clogging.

The configuration of the carrying section of the inkjet printer 1 is described next. As shown in FIG. 3, the carrying section has a paper insert opening 1A and a roll paper insert opening 11B, a paper supply motor (not shown), a paper supply roller 13, a platen 14, a paper feed motor (hereinafter, also referred to as PF motor) 15, a carry roller 17A and paper discharge rollers 17B, and free rollers 18A and free rollers 18B.

The paper insert opening 11A is where paper S, serving as a medium, is inserted. The paper supply motor (not shown) is a motor for carrying the paper S that has been inserted into the paper insert opening 11A into the printer 1, and is constituted by a pulse motor. The paper supply roller 13 is a roller for automatically carrying the medium S that has been inserted into the paper insert opening 11A into the printer 1 in the arrow A direction in the figure (in the case of roll paper, the arrow B direction), and is driven by the paper supply motor. The paper supply roller 13 has a cross-sectional shape that is substantially the shape of the letter D. The peripheral length of the circumference of the paper supply roller 13 is set longer than the carrying distance up to the PF motor 15, so that using this circumference, the medium S can be carried up to the PF motor 15. It should be noted that a plurality of the media S are prevented from being supplied at one time by the rotational drive force of the paper supply roller 13 and the friction resistance of separating pads (not shown).

The platen 14 is a support means for supporting the paper S during printing. The PF motor 15 is a motor for feeding paper, which is an example of the medium S, in the paper carrying direction, and is constituted by a DC motor. The carry roller 17A is a roller for feeding the paper S that has been carried into the printer 1 by the paper supply roller 13 up to a printable region, and is driven by the PF motor 15. The free rollers 18A are provided in a position that is in opposition to the carry roller 17A, and push the paper S toward the carry roller 17A by sandwiching the paper S between them and the carry roller 17A.

The paper discharge rollers 17B are rollers for discharging the paper S for which printing has finished to outside the printer 1. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

<System Configuration>

The following is a description concerning the system configuration of the inkjet printer 1. As shown in FIG. 4, the inkjet printer 1 is provided with a buffer memory 122, an image buffer 124, a system controller 126, a main memory 127, and an EEPROM 129. The buffer memory 122 receives and temporarily stores data such as print data sent from a host computer 140. The image buffer 124 obtains received print data from the buffer memory 122 and stores it. Furthermore, the main memory 127 is constituted by a ROM and a RAM for example.

On the other hand, the system controller 126 reads out a control program from the main memory 127 and carries out overall control of the printer 1 in accordance with the control program. The system controller 126 of the present embodiment is provided with a carriage motor controller 128, a carry controller 130, a head drive section 132, a rotary encoder 134, and a linear encoder 51. The carriage motor controller 128 performs drive control of the carriage motor 42 for such aspects as rotational direction, number of rotations, torque and the like. Also, the head drive section 132 performs driving control of the head 21. The carry controller 130 controls the various drive motors that are arranged in the carry system, such as the paper feed motor 15 that rotatively drives the carry roller 17A.

Print data that has been sent from the host computer 140 is temporarily held in the buffer memory 122. Necessary information contained in the print data held here is read out by the system controller 126. Based on the information that is read out, the system controller 126 controls the carriage motor controller 128, the carry controller 130, and the head drive section 132 in accordance with a control program while referencing output from the linear encoder 51 and the rotary encoder 134.

Print data for a plurality of color components received by the buffer memory 122 is stored in the image buffer 124. The head drive section 132 obtains print data of the various color components from the image buffer 124 according to control signals from the system controller 126, and drives and controls the nozzles for each of the colors provided in the head 21 based on that print data.

It should be noted that the inkjet printer 1 according to this embodiment is additionally also provided with a detection section 80 and an A/D converter 88. More detailed description of the detection section 80 and the A/D converter 88 is given later.

<Head>

Figure 5:
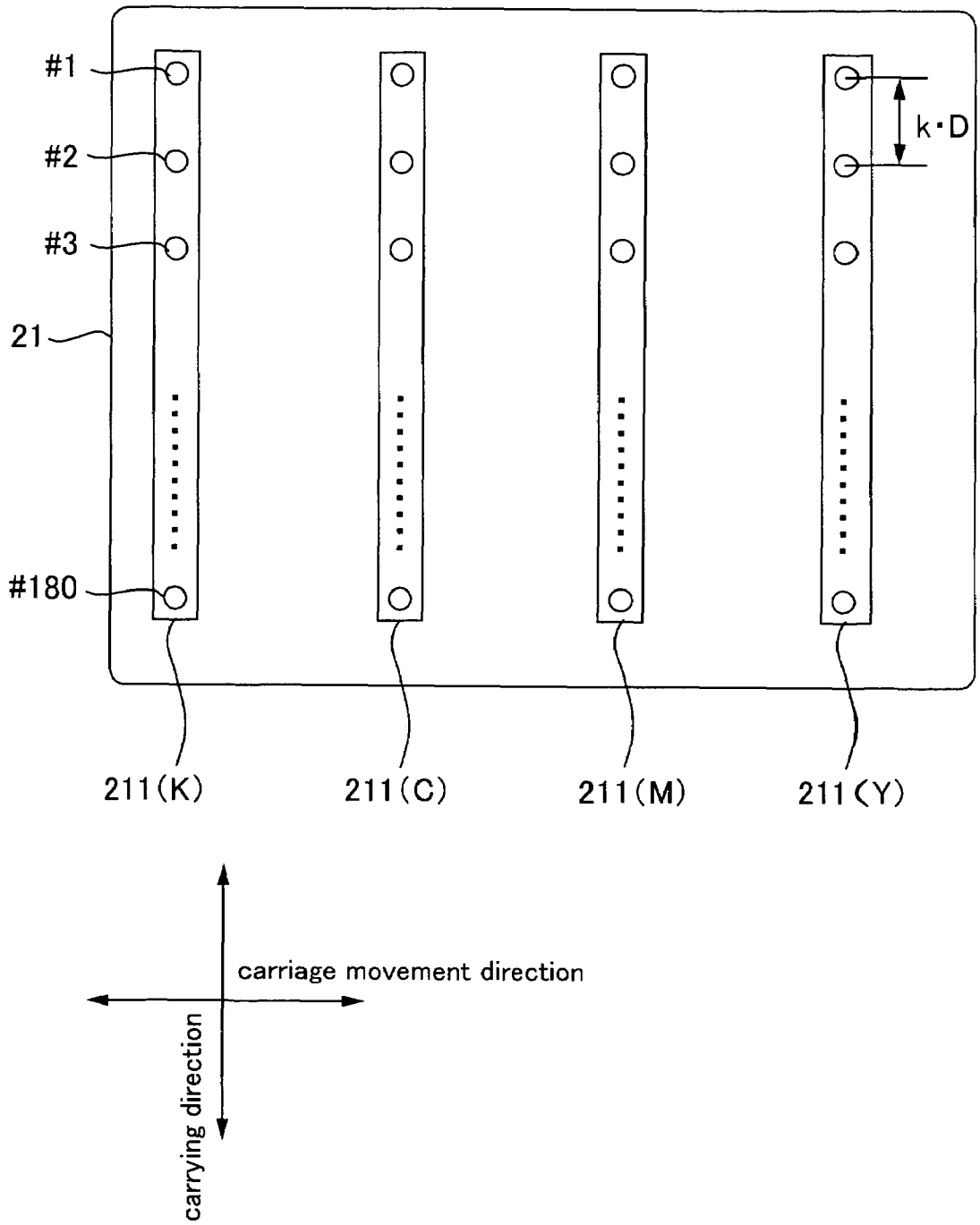
FIG. 5 is a plan view showing nozzles of the head.

FIG. 5 shows the arrangement of the ink nozzles provided on the lower surface section of the head 21. As shown in this diagram, nozzle rows 211(Y), 211(M), 211(C), and 211(K), each constituted by a plurality of nozzles #1 to #180 for one of the colors yellow (Y), magenta (M), cyan (C), and black (K), are provided in the lower surface section of the head 21.

The nozzles #1 to #180 of the nozzle rows 211(Y), 211(M), 211(C), and 211(K) are arranged linearly in the carrying direction of the paper S. The nozzle rows 211(Y), 211(M), 211(C), and 211(K) are arranged in parallel, with spaces between the rows, in the movement direction (scanning direction) of the head 21. Each of the nozzles #1 to #180 is provided with a piezo element (not shown) as a drive element for ejecting droplets of ink.

When a voltage of a predetermined duration is applied between electrodes provided at both ends of a piezo element, the piezo element expands for the duration of voltage application and deforms a lateral wall of an ink channel. As a result, the volume of the ink channel is constricted by an amount according to the expansion of the piezo element, and ink corresponding to this amount of constriction becomes an ink droplet, which is ejected from the relevant color nozzle #1 to #180.

Figure 6:
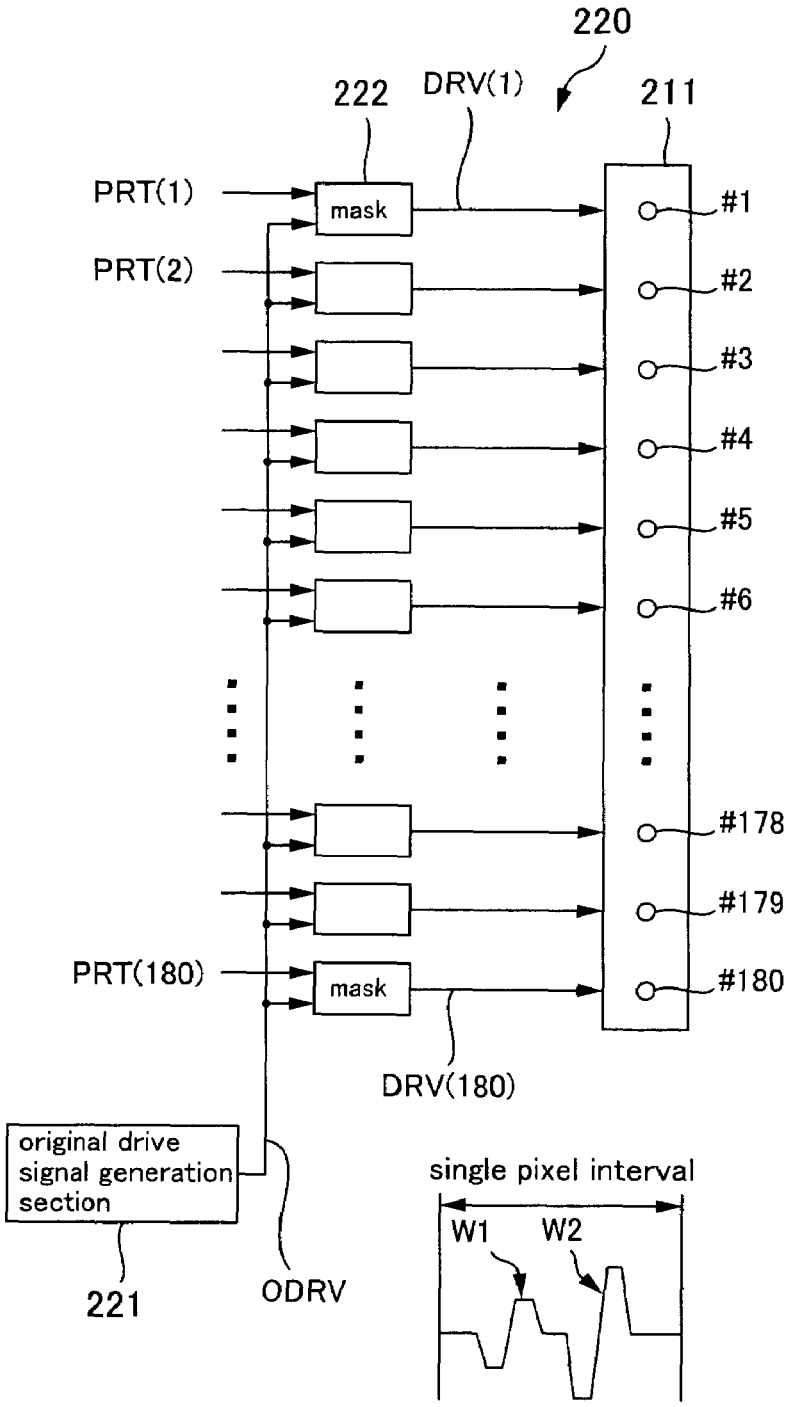
FIG. 6 is a circuit diagram showing one embodiment of a nozzle drive circuit.

FIG. 6 shows a drive circuit 220 of the nozzles #1 to #180. As shown in this diagram, the drive circuit 220 is provided with an original drive signal generation section 221 and a plurality of mask circuits 222. The original drive signal generation section 221 creates an original signal ODRV that is shared by the nozzles #1 to #180. As shown in a lower portion of this diagram, the original signal ODRV is a signal that includes two pulses, a first pulse W1 and a second pulse W2, during the main scanning period of a single pixel (i.e., during the period that the carriage 41 crosses over a single pixel). The original signal ODRV created by the original drive signal generation section 221 is output to each mask circuit 222.

The mask circuits 222 are provided corresponding respectively to the plurality of piezo elements for driving the nozzles #1 to #180 of the head 21. Each mask circuit 222 receives the original signal ODRV from the original signal generation section 221 and also receive a print signal PRT(i). The print signal PRT(i) is pixel data corresponding to a pixel and is a binary signal having 2-bit information corresponding to a single pixel. The bits respectively correspond to the first pulse W1 and the second pulse W2. The mask circuits 222 are gates for blocking the original signal ODRV or allowing it to pass depending on the level of the print signal PRT(i). That is, when the print signal PRT(i) is level "0," the pulse of the original signal ODRV is blocked, but when the print signal PRT(i) is level "1," the corresponding pulse of the original signal ODRV is allowed to pass unchanged and is output toward the piezo elements of the nozzles #1 to #180 as a drive signal DRV. The piezo elements of the nozzles #1 to #180 are driven by the drive signals DRV from the mask circuits 222 and eject ink.

Figure 7:
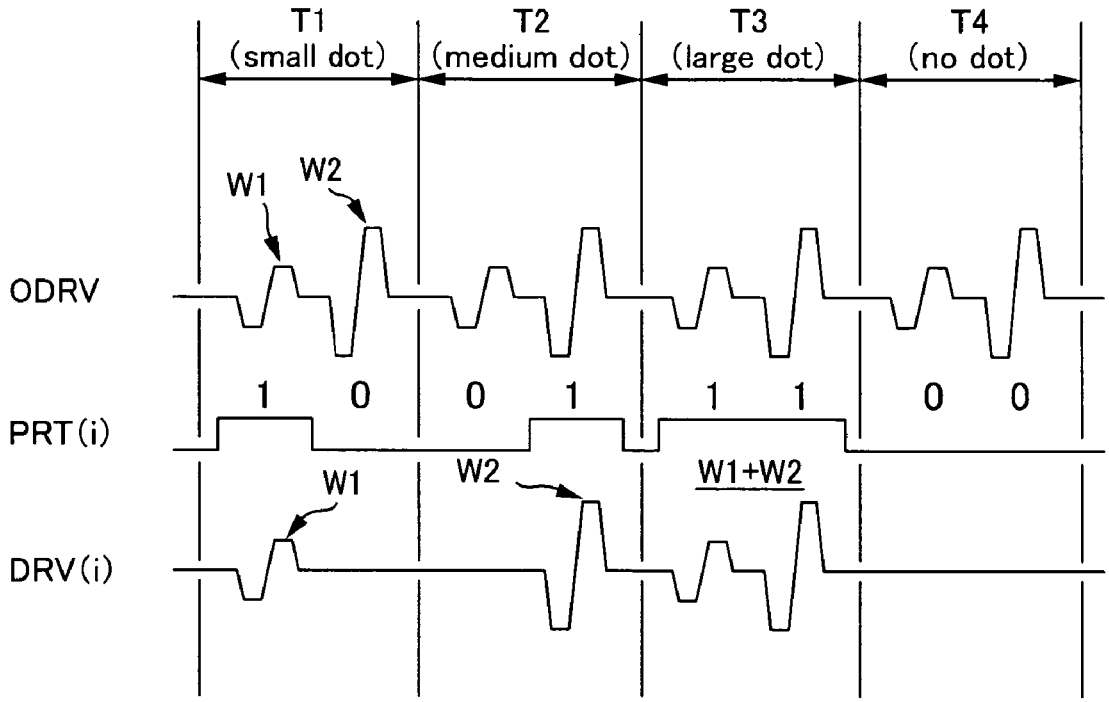
FIG. 7 is a timing chart of the original signal ODRV, the print signal PRT(i), and the drive signal DRV(i) indicating the operation of the drive signal generation section.

FIG. 7 is a timing chart for an original signal ODRV, a print signal PRT(i), and a drive signal DRV(i), which indicate the operation of the original drive signal generation section 221. As shown in this diagram, the original signal ODRV generates a first pulse W1 and a second pulse W2 in that order during each pixel interval T1, T2, T3, and T4. It should be noted that "pixel interval" has the same meaning as the movement interval of the carriage 41 for a single pixel.

When the print signal PRT(i) corresponds to the two bits of pixel data "10" then only the first pulse W1 is output in the first half of the pixel interval. Accordingly, a small ink droplet is ejected from the nozzles #1 to #180, forming small-sized dots (small dots) on the medium. When the print signal PRT(i) corresponds to the two bits of pixel data "01" then only the second pulse W2 is output in the second half of the pixel interval. Accordingly, a medium ink droplet is ejected from the nozzles #1 to #180, forming medium-sized dots (medium dots) on the medium. Furthermore, when the print signal PRT(i) corresponds to the two bits of pixel data "11" then the first pulse W1 and the second pulse W2 are output during the pixel interval. Accordingly, a large ink droplet is ejected from the nozzles #1 to #180, forming large-sized dots (large dots) on the medium. As described above, the drive signal DRV(i) in a single pixel interval is shaped so that it may have three different waveforms corresponding to three different values of the print signal PRT(i), and based on these signals, the head 21 can form dots of three different sizes and can adjust the amount of ejected ink between pixel intervals. Furthermore, when the print signal PRT(i) corresponds to the two bits of pixel data "00" as in the pixel interval T4, then no ink droplet is ejected from the nozzles #1 to #180 and no dot is formed on the medium.

In the inkjet printer 1 according to the present embodiment, the drive circuits 220 of the nozzles #1 to #180 are arranged separately for each of the nozzle rows 211, that is, for each of the colors yellow (Y), magenta (M), cyan (C), and black (K), such that piezo elements are driven separately for each of the nozzles #1 to #180 of the nozzle rows 211.

Printing Operation

Figure 8:
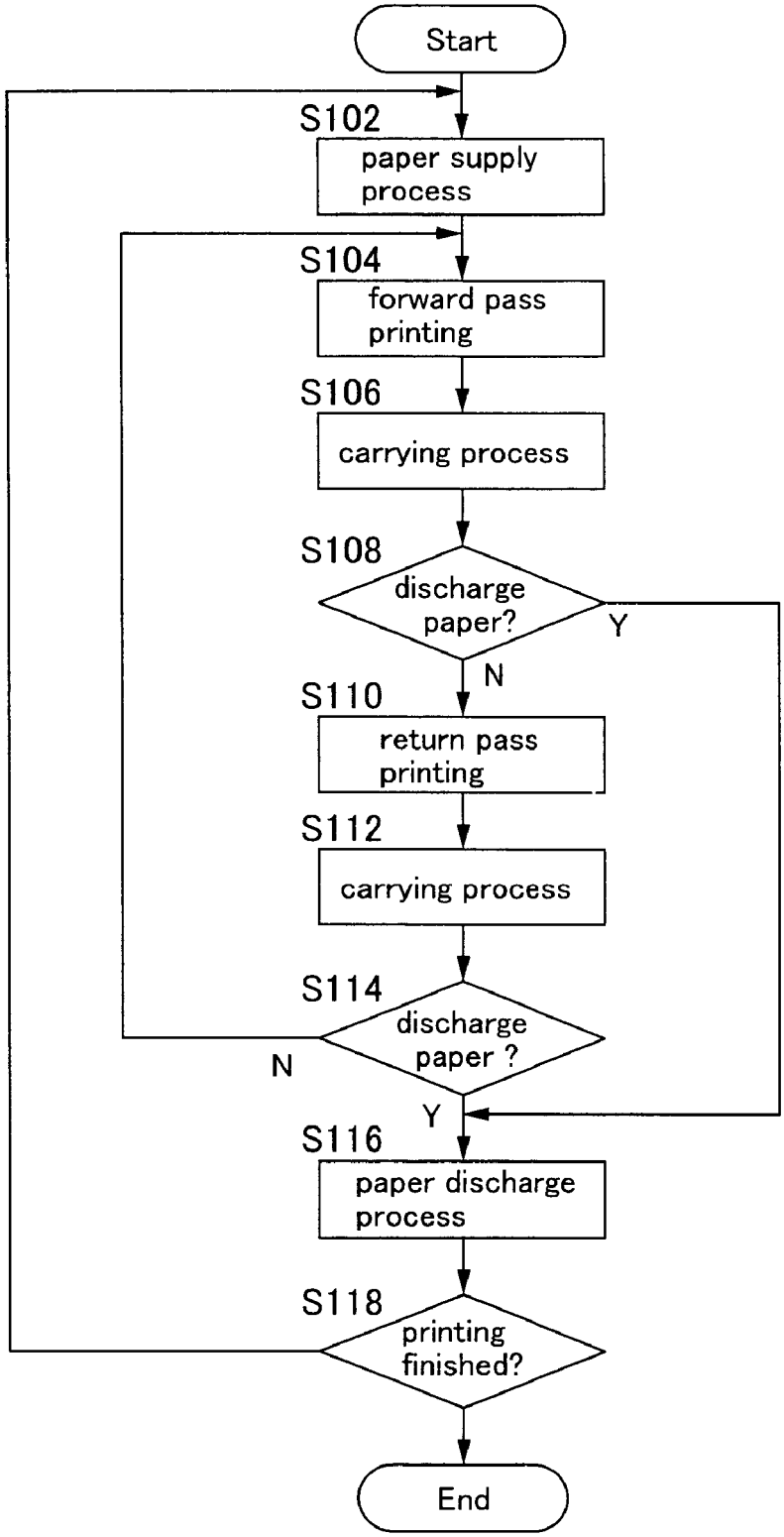
FIG. 8 is a flowchart for describing an example of the flow of processes in a printing process.

The printing operation of the inkjet printer 1 discussed above is described next. Here, an example of "bidirectional printing" is described. FIG. 8 is a flowchart showing an example of the procedure of the printing operation of the inkjet printer 1. The processes described below are executed by the system controller 126 reading a program stored on the main memory 127 or the EEPROM 129 and controlling the various units in accordance with this program.

When the system controller 126 receives print data from the host computer 140, it first performs a paper supply process (S102) in order to be able to execute printing based on this print data. The paper supply process is a process for supplying a medium to be printed, which is paper in this case, into the printer 1 and carrying it up to a print start position (also referred to as the "indexed position"). The system controller 126 rotates the paper supply roller 13 to feed the paper to be printed up to the carry roller 17A. The system controller 126 rotates the carry roller 17A to position the paper that has been fed from the paper supply roller 13 at the print start position.

Next, the system controller 126 executes a printing process in which the carriage 41 is moved relative to the paper and printing is executed with respect to the paper. Here, first a forward pass printing of moving the carriage 41 in one direction along the guide rail 46 while ejecting ink from the head 21 is performed (S104). The system controller 126 drives the carriage motor 42 to move the carriage 41 and also drives the head 21 to eject ink based on the print data. The ink that is ejected from the head 21 reaches the paper and forms dots.

Once printing has been executed in this manner, a carrying process of carrying the paper by a predetermined amount is performed (S106). In this carrying process, the system controller 126 drives the paper feed motor 15 to rotate the carry roller 17A so as to carry the paper by a predetermined amount in the carrying direction relative to the head 21. Through this carrying process, the head 21 can print on a different region from the region printed previously.

Once carrying has been performed in this manner, a paper discharge determination of whether or not to discharge the paper is performed (S108). Here, if there is no other data for printing on the paper being printed, then a paper discharge process is performed (S116). On the other hand, if there is other data for printing on the paper being printed, then a return pass printing is executed without performing the paper discharge process (S110). In the return pass printing, printing is performed by moving the carriage 41 along the guide rail 46 in the direction opposite that of the forward pass printing immediately prior. Similar to before, the system controller 126 rotatively drives the carriage motor 42 in the opposite direction from the previous direction to move the carriage 41 and drives the head 21 to eject ink based on the print data, thereby executing printing.

Once the return pass printing has been performed, the carrying process is executed (S112) and then the paper discharge determination is performed (S114). Here, if there is other data for printing to the paper being printed, then the procedure returns to S104 without performing the paper discharge process and forward pass printing is performed again (S104). On the other hand, if there is no more data to be printed to the paper being printed, then the paper discharge process is performed (S116).

Once the paper discharge process has been performed, a print over determination is executed to determine whether or not printing is finished (S118). Here, the system controller 126 checks whether or not there is a subsequent paper to be printed based on the print data from the host computer 140. If there is a subsequent paper to be printed, then the procedure returns to step S102 and the paper supply process is performed again to start printing. On the other hand, if there is no subsequent paper to be printed, then the printing process is ended.

Apparatus for Inspecting Liquid Ejection

An embodiment of an apparatus for inspecting liquid ejection according to the present invention is described next. Here, a case in which an apparatus for inspecting liquid ejection according to the present invention is installed in an inkjet printer (liquid ejecting apparatus) is described as an example.

<Overview of Inspecting Apparatus>

Figure 9:
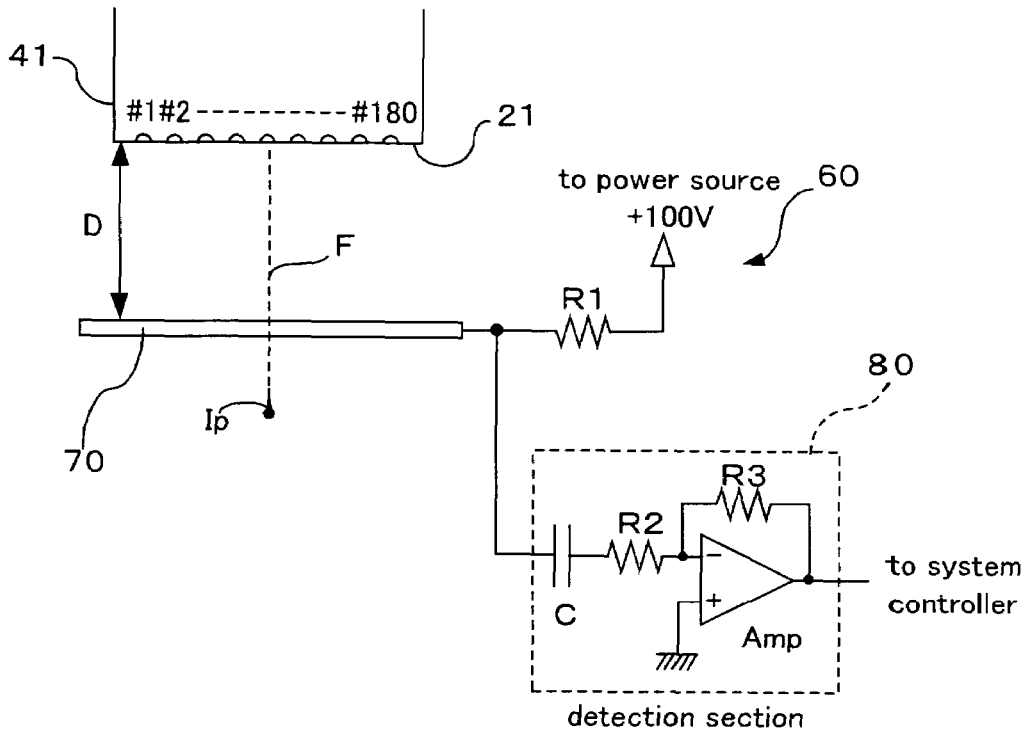
FIG. 9 is an explanatory diagram illustrating the apparatus for inspecting liquid ejection of the present embodiment.
Figure 10:
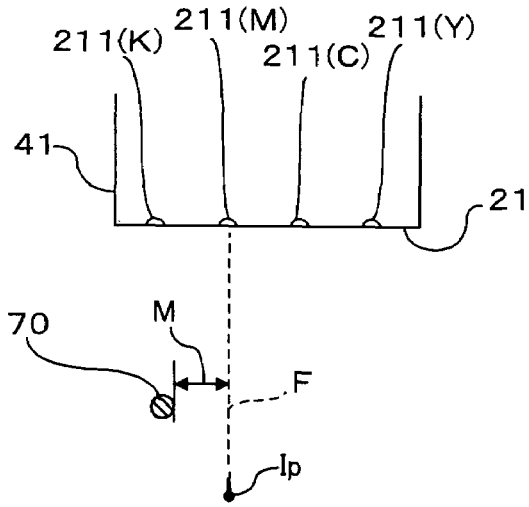
FIG. 10 is an explanatory diagram illustrating an inspection principle of the apparatus for inspecting liquid ejection of the present embodiment.

FIGS. 9 and 10 schematically illustrate a liquid ejection inspecting apparatus 60 installed in the inkjet printer 1 of the present embodiment and an inspecting method thereof. FIG. 9 is an explanatory diagram illustrating the configuration of the liquid ejection inspecting apparatus 60 and FIG. 10 is an explanatory diagram illustrating the inspection principle of the liquid ejection inspecting apparatus 60.

As shown in FIG. 9, the liquid ejection inspecting apparatus 60 is provided with a sensing section 70 arranged in such a position that it can be brought into opposition to the head 21, and a detection section 80 that is connected to the sensing section 70. The sensing section 70 is made of a conductive wire material that is made of, for example, a metal, and is arranged in parallel to the head 21 in a state that it is stretched into a state of tension. The sensing section 70 is arranged such that, when the carriage 41 moves, there is a spacing D between the sensing section 70 and the head 21, and the sensing section 70 and the head 21 can face each other in a state of non-contact. The spacing D between the head 21 and the sensing section 70 is set to 1 mm for example.

Furthermore, the sensing section 70 is connected to a power source (not shown) via a protective resistor R1. The sensing section 70 is configured so as to be supplied with a high voltage of, for example, +100V (volts) from the power source.

On the other hand, the detection section 80 is configured to detect the electric current that occurs in the sensing section 70. In the present embodiment, the detection section 80 is constituted by a detection circuit that is provided with a capacitor C, an input resistor R2, a feedback resistor R3, and an operational amplifier Amp. When a current variation occurs in the sensing section 70, the capacitor C fulfills the role of inputting the current variation as an electric signal to the operational amplifier Amp via the input resistor R2. Furthermore, the operational amplifier Amp fulfills a role as an amplifier circuit by amplifying and outputting the signal that has been input through the capacitor C. The output signal from the operational amplifier Amp is converted, for example, from an analog signal to a digital signal by the A/D converter 88 (see FIG. 4) and is output toward the system controller 126 in an appropriate form such as digital data for example.

When ejection inspection is actually carried out, an operation is carried out in which each of the nozzles #1 to #180 of the head 21 separately ejects ink toward the sensing section 70 or its vicinity. FIG. 10 illustrates the circumstance of ink being ejected from a particular nozzle of the head 21 toward the vicinity of the sensing section 70. Here, an ink droplet Ip of a one-time amount, that is, a one-droplet amount, is ejected from each of the respective nozzles #1 to #180 of the head 21.

At this time, an extremely high voltage of +100V (volts), for example, is being applied to the sensing section 70 by the voltage supplied from the power source. This forms an extremely strong electric field between the head 21 and the sensing section 70. When an ink droplet Ip from the nozzles #1 to #180 is ejected in such conditions, the ejected ink droplet Ip is caused to become electrically charged.

The ink droplet Ip that has been ejected from the nozzles #1 to #180 and has become charged passes the vicinity of the sensing section 70. When the charged ink droplet Ip passes the vicinity of the sensing section 70, an induced current is produced in the sensing section 70 in a predetermined direction. It should be noted that the induced current thus produced is can be thought of as being caused by electrostatic induction or the like accompanying the approach of the charged ink droplet Ip.

At this time, an induced current of an intensity corresponding to a distance M between the sensing section 70 and a flight path F of the ink droplet Ip is produced in the sensing section 70. That is, as the flight path F of the ink droplet Ip becomes closer to the sensing section 70, the intensity of the induced current produced in the sensing section 70 becomes larger, and if the flight path F of the ink droplet Ip is located away from the sensing section 70, then the intensity of the induced current produced in the sensing section 70 becomes smaller.

A fluctuation in the electric current that is input to the detection section 80 occurs when an induced current is produced in the sensing section 70 in this way. This current fluctuation is input as an electrical signal to the operational amplifier Amp via the input resistor R2. The signal that is input to the operational amplifier Amp is then amplified and output toward the system controller 126 or the like. In this way, when an induced current is produced in the sensing section 70, this fact is detected by the detection section 80 and a detection signal thereof is converted from an analog signal to digital data or the like by the A/D converter 88 (see FIG. 4) to be output toward the system controller 126.

From the data from the detection section 80, the system controller 126 determines whether or not ink was ejected by, for example, comparing the current level, that is, the intensity of the induced current produced in the sensing section 70 with a predetermined reference level. The predetermined reference level is set to an appropriate value so that errors do not occur in ejection inspection. It should be noted that information concerning the predetermined reference level is stored as data in an appropriate storage section such as a memory, which includes the main memory 127 or the EEPROM 129 for example. In comparing the current level of the induced current and the predetermined reference level, the system controller 126 obtains information concerning the reference level from the appropriate storage section such as the main memory 127 and the EEPROM 129.

On the other hand, when the ink droplet Ip is not ejected properly from the nozzles #1 to #180, no charged ink droplet Ip passes the vicinity of the sensing section 70, and therefore no induced current is produced in the sensing section 70. For this reason, a detection signal is not sufficiently output from the detection section 80, and therefore it is possible to easily examine whether or not ink is being ejected properly for each of the nozzles #1 to #180.

It should be noted that it is preferable that the size of the ink droplet Ip ejected from the nozzles #1 to #180 during ejection inspection is as large as possible. That is, it is preferable that the dot size is set to a size approximately equivalent to the largest dot size of the inkjet printer 1 in the present embodiment, for example, the ink droplet Ip ejected to form a large dot ("11") on the medium. This is because the larger the size of the ink droplet Ip ejected from the nozzles #1 to #180, the easier it becomes to charge the ink droplet ejected from the nozzle, so that it is possible to produce an induced current in the sensing section 70 with greater reliability and it is easier to carry out detection using the detection section 80.

Of course, it is not necessarily required to set the size of the ink droplet Ip ejected during ejection inspection to the size when forming the largest dot size (large dot, etc). That is, it is also possible to eject a special large sized ink droplet Ip only during ejection inspection, and it is possible to eject small sized ink droplets Ip.

Furthermore, the ink droplet Ip that is ejected from the nozzles #1 to #180 does not necessarily have to be ejected toward the vicinity of the sensing section 70, but may also be ejected so as to make contact with the sensing section 70. In this case also, an induced current is produced in the sensing section 70 by the approach of the ink droplet Ip to the sensing section 70, and therefore it is also possible to examine whether or not the ink droplet Ip is being ejected.

<Sensing Section>

Figure 11A:
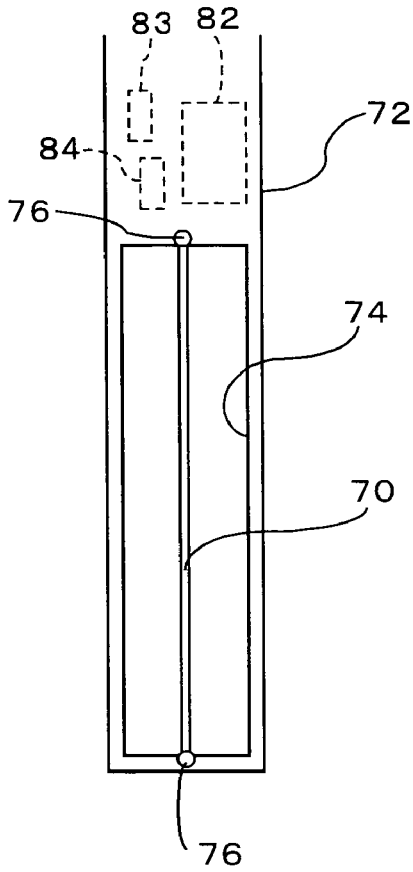
FIG. 11A is a plan view of a sensing section of the present embodiment.
Figure 11B:
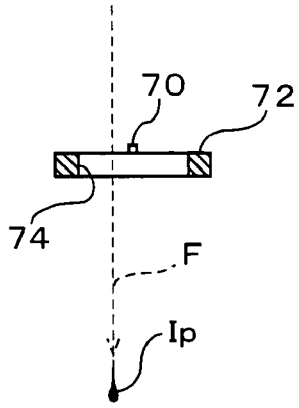
FIG. 11B is a vertical cross sectional view of the sensing section of the present embodiment.

FIGS. 11A and 11B show the sensing section 70 of the present embodiment in greater detail. FIG. 11A is a plan view of the sensing section 70 and FIG. 11B is a vertical cross sectional view of the sensing section 70.

As shown in FIG. 11A, the sensing section 70 of the present embodiment is arranged on a rectangular-shaped substrate 72. The substrate 72 is a printed circuit board. The sensing section 70 is arranged spanning the lengthwise direction of the substrate 72, that is, along the longitudinal direction, at an aperture portion 74 formed at a front end area (lower end area) of the substrate 72. Both ends of the sensing section 70 are fixed by respective fixing members 76 at an inner edge of the aperture portion 74. The sensing section 70 is attached in a condition stretching longitudinally over the aperture portion 74 of the substrate 72. The ink droplets Ip ejected from the nozzles #1 to #180 of the head 21 drop downward while passing by a side of the sensing section 70 (here, the left side of the sensing section 70) through the aperture portion 74 of the substrate 72.

In the present embodiment, circuit elements 82, 83, and 84 constituted by such components as the protective resistor R1, the capacitor C, the input resistor R2, the feedback resistor R3, and the operational amplifier Amp, which constitute the detection section 80, are mounted integrally on the substrate 72. In this way, the substrate 72 provided with the sensing section 70 and the circuit elements 82, 83, and 84 is configured as an ejection inspection unit for carrying out ejection inspection of the nozzles #1 to #180 of the nozzle rows 211 of the head 21.

<Installation Position of Sensing Section>

Figure 12:
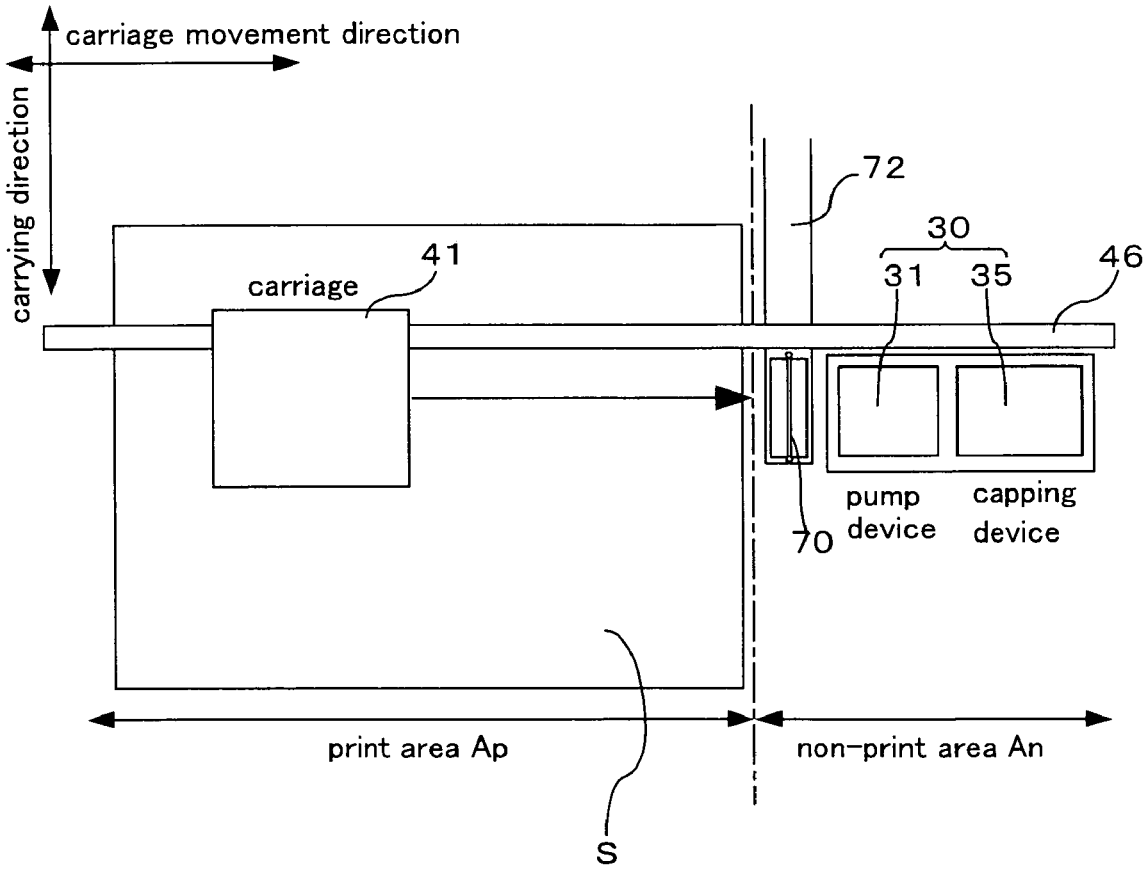
FIG. 12 is an explanatory diagram that illustrates an installation position of the sensing section of the present embodiment.

FIG. 12 illustrates the installation position of the sensing section 70 in greater detail. As shown in this diagram, the sensing section 70 of the present embodiment is arranged in an area An (hereinafter referred to as "non-print area") apart from a print area Ap in which printing is carried out by the ejection of ink from the nozzles #1 to #180. The pump device 31 is provided in the non-print area An as a cleaning apparatus for the nozzles #1 to #180 and sucks out ink from the nozzles #1 to #180 in order to eliminate clogging of the nozzles. Furthermore, the capping device 35 is provided in the non-print area An and seals the nozzles #1 to #180 of the head 21 when printing is not being performed. The cleaning unit 30 is constituted by the pump device 31 and the capping device 35. In addition to these, various other devices may be arranged in the cleaning unit 30 such as a wiping apparatus to wipe away any extra ink that has adhered at the openings of the nozzles #1 to #180.

In the present embodiment, the sensing section 70 is arranged in a position inside the non-print area An that is close to the print area Ap, that is, between the print area Ap and the cleaning unit 30 as shown in the diagram. This ensures that the carriage 41 always passes over the sensing section 70 when the carriage 41 moves from the print area Ap to the non-print area An. This makes it possible to carry out ink ejection inspection during any non-printing time in which the carriage 41 moves into the non-print area An.

<Positional Relationship Between Sensing Section and Nozzle Rows>

Figure 13:
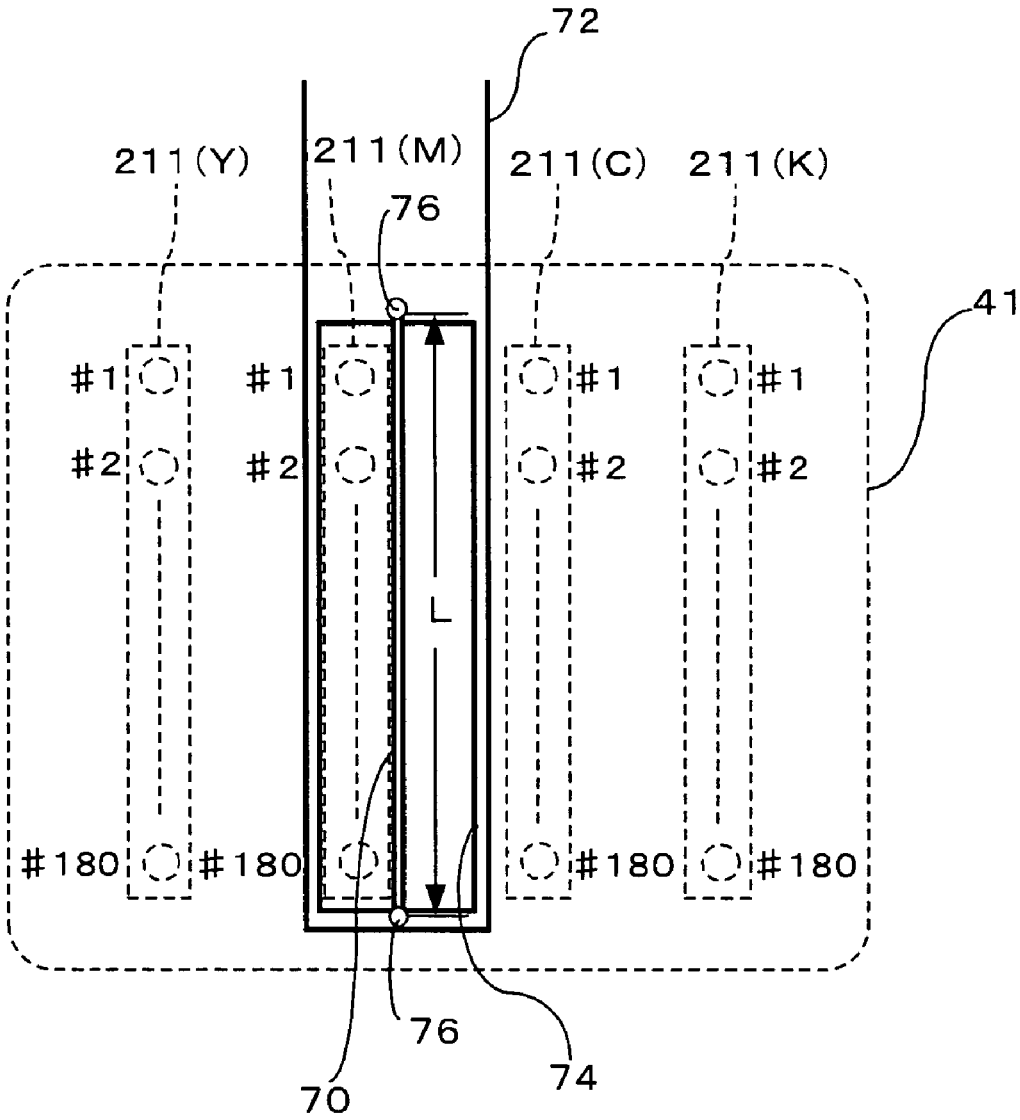
FIG. 13 is an explanatory diagram that illustrates a positional relationship between the sensing section and the nozzle rows in the present embodiment.

FIG. 13 illustrates the positional relationship between the sensing section 70 and the nozzle rows 211 when ejection inspection is carried out. As shown in the diagram, the sensing section 70 is positioned along and parallel to the nozzle rows 211 and its length L is set longer than the length of the nozzle rows 211. In this way, the sensing section 70 is formed in correspondence to a length of one row of the nozzle rows 211.

As shown in the diagram, when carrying out ejection inspection, one nozzle row (here nozzle row 211 (M)) of the plurality of nozzle rows 211 provided in the head 21 is positionally aligned so as to be in a position directly above a side (directly above on the left side in the diagram here) of the sensing section 70. After this positional alignment is finished, ejection inspection is carried out by having each of the nozzles #1 to #180 of the particular nozzle row 211 (here, nozzle row 211 (M)) individually eject ink toward the sensing section.

After ejection inspection has been finished for one of the nozzle rows 211 (here, nozzle row 211 (M)), the carriage 41 moves so that ejection inspection can be carried out for a subsequent nozzle row 211 for which ejection inspection is yet to be performed. Positional alignment of the sensing section 70 and the nozzle row 211 to be ejection inspected next (here, the nozzle row 211 (Y) for example), is then performed again and ejection inspection is executed for that nozzle row 211. In this way, ejection inspection is carried out row by row for each of the plurality of nozzle rows 211 provided in the head 21.

<Ink Recovery Section>

Figure 14:
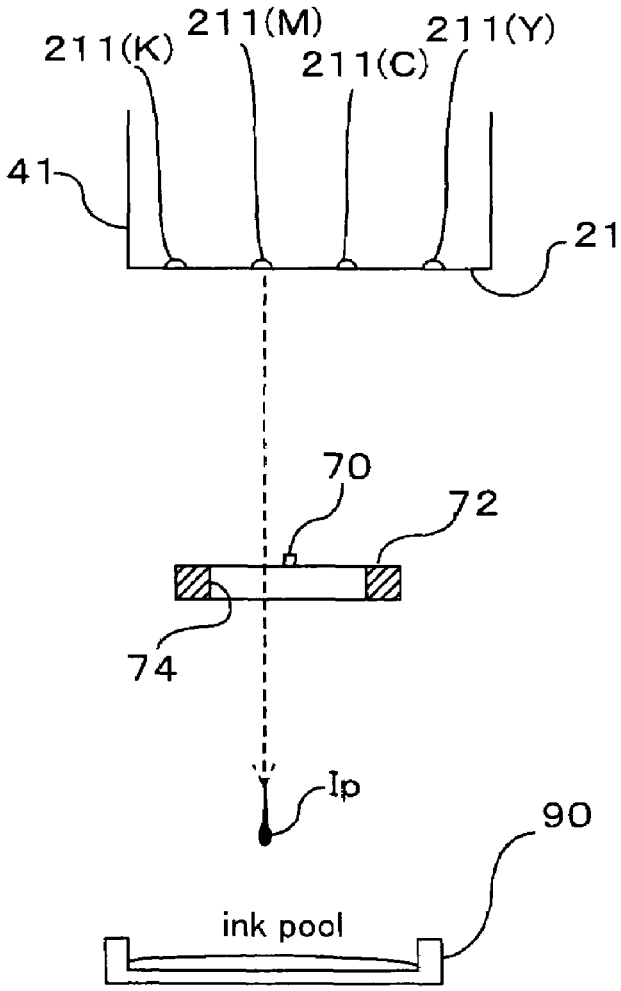
FIG. 14 is an explanatory diagram that illustrates an ink recovery section of the present embodiment.

In the inkjet printer 1 according to the present embodiment, an ink recovery section 90 is provided to recover the ink used in ejection inspection. FIG. 14 is a diagram illustrating the ink recovery section 90. As shown in the diagram, the ink recovery section 90 is installed for example below the substrate 72 on which the sensing section 70 is provided, and here, collects for recovery the ink droplets Ip that are ejected from the nozzles #1 to #180 of the head 21, pass by the side of the sensing section 70 and drop through the aperture portion 74 of the substrate 72. By using the ink recovery section 90 to recover the ink used in ejection inspection, the inside of the printer 1 can be kept from being soiled by the ink.

It should be noted that, as shown in the diagram, the ink recovery section 90 in the present embodiment is formed as a concave container, but as long as the ink used in ejection inspection is recovered, it is also possible to provide a grooved portion or the like in which a shape that is concave in profile is formed on the platen 14 or the like.

<Actual Detection Waveform>

Figure 15:
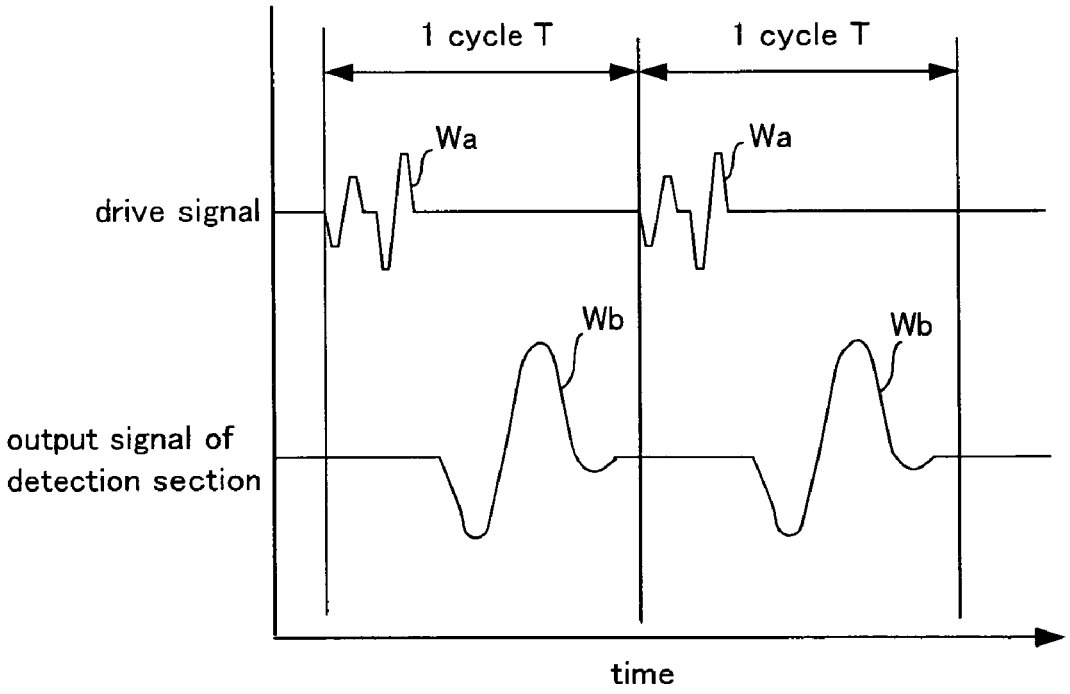
FIG. 15 is an explanatory diagram that shows waveforms of a drive signal of the nozzles and an output signal of the detection section.

FIG. 15 shows the respective waveforms of a drive signal that is output to the nozzles in order to achieve ink ejection during ejection inspection and an output signal from the detection section 80. The upper waveform in this diagram shows the drive signal waveform, and the lower waveform in this diagram shows the output signal waveform of the detection section 80. When ejection inspection is to be carried out for a particular nozzle, a drive pulse Wa for causing ejection of an ink droplet one time, that is, one droplet, is output as shown in the diagram as a drive signal to the piezo element arranged in the nozzle targeted for inspection.

On one hand, when ink is properly ejected from the nozzle targeted for inspection due to the drive signal, an induced current is produced in the sensing section 70 by the ink droplet Ip that is ejected from the nozzle targeted for inspection, and this induced current is detected by the detection section 80, and a pulse Wb that oscillates up and down as shown in the diagram is output as a detection signal from the detection section 80. Since it takes some time from when the ink droplet Ip is ejected from the nozzle targeted for inspection until the induced current is produced and since there is a slight time lag until when the induced current that is produced is detected by the detection section 80 and output, the rising edge of the pulse of the detection signal that is output from the detection section 80 is delayed compared to the drive pulse of the drive signal.

On the other hand, when ink is not properly ejected from the nozzles #1 to #180, no induced current is produced in the sensing section 70 and therefore a waveform of the pulse Wb such as that shown in the diagram does not appear clearly in the waveform of the output signal of the detection section 80.

It should be noted that ejection inspection is carried out collectively for a plurality of nozzles, for example, in units of one row of the nozzle rows 211, that is, in units of 180 nozzles of the nozzles #1 to #180. For this reason, as shown in the diagram, the drive signal is shaped such that drive pulses, each for ejecting a one-time portion (one droplet portion) of the ink droplet Ip being inspected, are output repetitively at a predetermined cycle T. Then, if ink is properly ejected from each of the nozzles #1 to #180 in accordance with the drive signal, the output signal of the detection section 80 becomes shaped such that pulses Wb having wavelike shapes are formed in each predetermined cycle T, as shown in the diagram. Here, the predetermined cycle T may be set as appropriate based on the time from when the drive pulse Wa for the nozzles #1 to #180 targeted for inspection is output until the pulse Wb appears in the detection signal of the detection section 80. By checking individually the detection signal from the detection section 80 in each cycle T, it is possible to easily execute individual inspection with respect to each of the nozzles #1 to #180.

<Determining the Ejection Direction>

With the inkjet printer 1 according to the present embodiment, it is possible to inspect whether or not the ejection direction of ink ejected from each of the nozzles #1 to #180 of each of the nozzle rows 211 is proper. Here, the determination of whether or not the direction of ink ejected from each of the nozzles #1 to #180 of each of the nozzle rows 211 is correct is carried out by the system controller 126. The system controller 126 receives as digital data the output signal that is output from the detection section 80 and carries out the determination by analyzing the waveform of the output signal based on the digital data.

Figure 16:
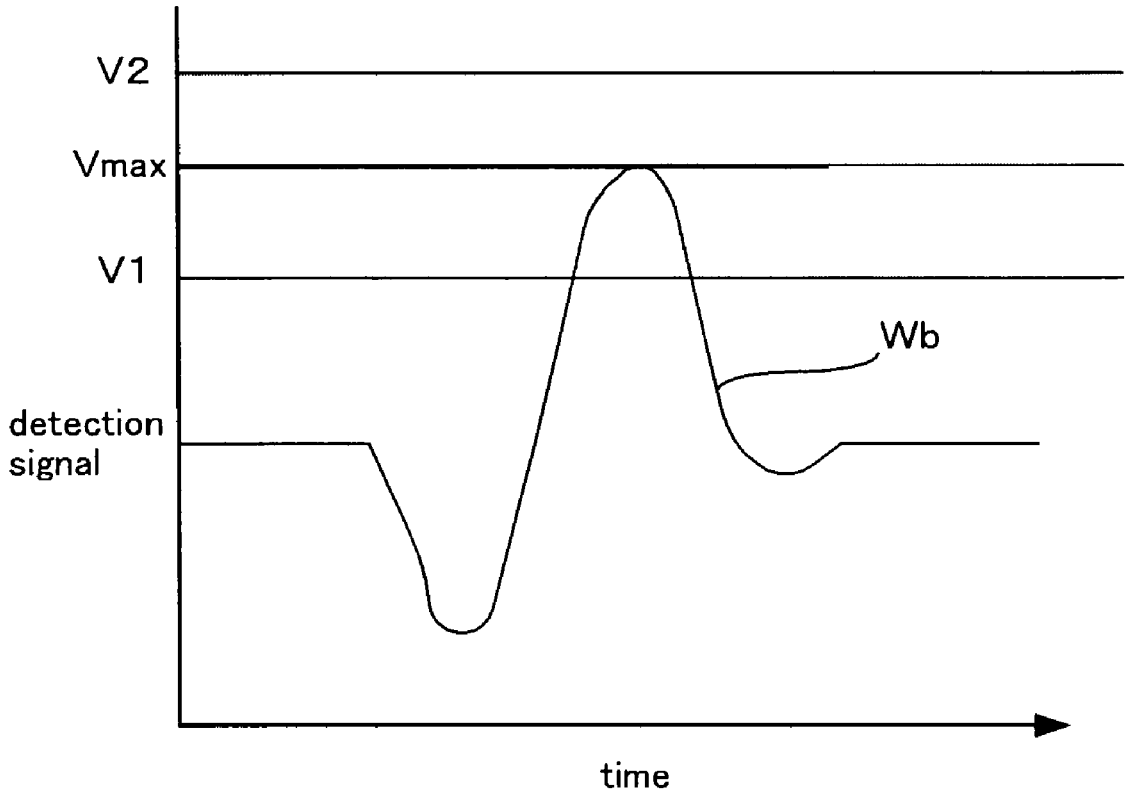
FIG. 16 is an explanatory diagram that illustrates an example of a method for determining whether or not the ejection direction of ink is proper.

FIG. 16 illustrates an example of a method for determining whether or not the ejection direction of ink is correct according to the present embodiment. In this determination, a peak value Vmax is obtained from the waveform Wb of the output signal obtained from the detection section 80. A check is then performed as to whether or not the obtained peak value Vmax is within a predetermined tolerance. That is, since the obtained peak value Vmax changes in accordance to the distance M between the sensing section 70 and the flight path F of the ink droplet Ip, it is possible to ascertain the distance M between the sensing section 70 and the flight path F of the ink droplet Ip by obtaining the peak value Vmax, and in this way it is possible to check whether or not there is any abnormality in the ejection direction of the ink droplets Ip ejected from each nozzle.

Here, the predetermined tolerance is set between a value V1 and a value V2. The value V1 is the lower limit of the peak value Vmax and prescribes the upper limit of the distance M between the sensing section 70 and the flight path F of the ink droplet Ip. Furthermore, the value V2 is the upper limit of the peak value Vmax and prescribes the lower limit of the distance M between the sensing section 70 and the flight path F of the ink droplet Ip. The values V1 and V2 are set using a predetermined tolerance with respect to a reference distance between the sensing section 70 and the standard path by which the ink droplet Ip should ordinarily travel. In this way, when the flight path F of the ink droplet Ip greatly deviates from the standard path and is too close to the sensing section 70, the peak value Vmax of the output signal from the detection section 80 exceeds the value V2, and therefore it is possible to determine that the ejection direction of the ink droplet Ip is not proper. Furthermore, when the flight path F of the ink droplet Ip is too far away from the sensing section 70, the peak value Vmax of the output signal from the detection section 80 falls below the value V1, and therefore it is possible to determine that the ejection direction of the ink droplet Ip is not proper.

Figure 17A:
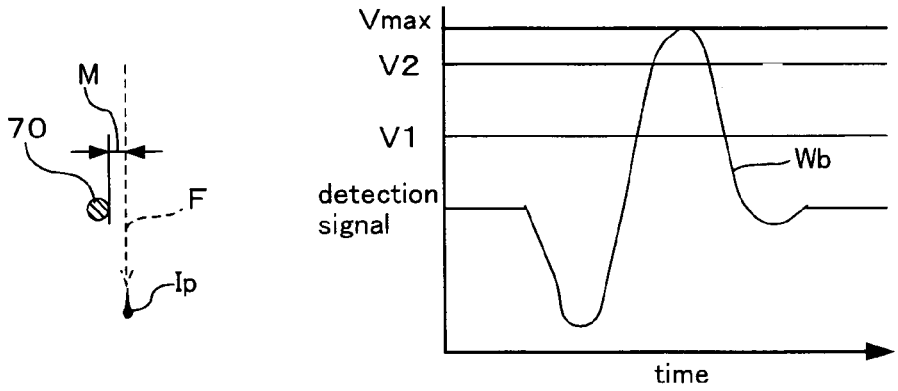
FIG. 17A is an explanatory diagram of a case in which the flight path F of the ink droplet is extremely close to the sensing section 70.
Figure 17B:
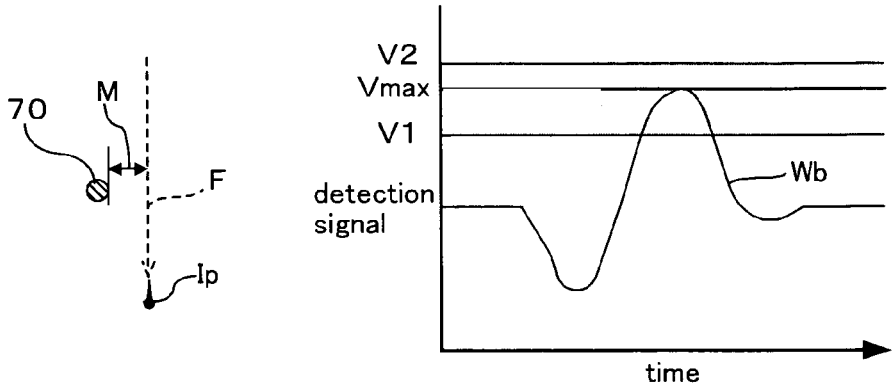
FIG. 17B is an explanatory diagram showing a case in which the flight path of the ink droplet is within tolerance.
Figure 17C:
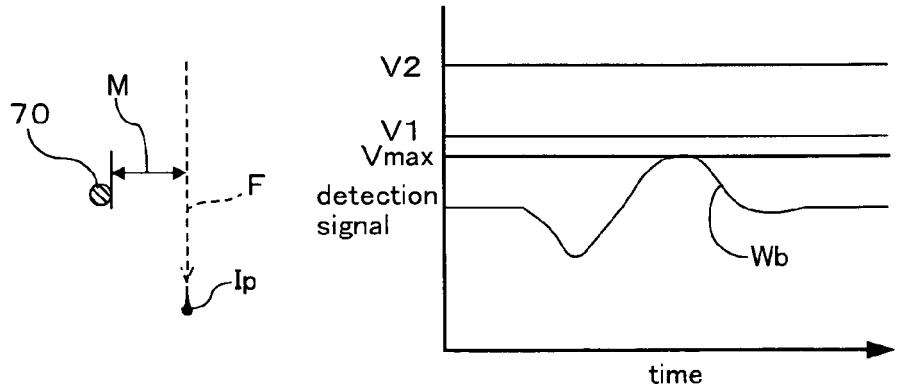
FIG. 17C is an explanatory diagram showing a case in which the flight path of the ink droplet is too far away from the sensing section.

FIGS. 17A, 17B, and 17C show the relationship between the distance M between the sensing section 70 and the flight path F of the ink droplet Ip, and the waveform of the detection signal from the detection section 80. FIG. 17A shows a case in which the flight path F of the ink droplet Ip is extremely close to the sensing section 70. FIG. 17B shows a case in which the flight path F of the ink droplet Ip is within tolerance. FIG. 17C shows a case in which the flight path F of the ink droplet Ip is too far away from the sensing section 70.

As shown in FIG. 17A, when the flight path F of the ink droplet Ip is extremely close to the sensing section 70, the peak value Vmax of the signal waveform of the detection signal from the detection section 80 exceeds the upper limit value V2 of the predetermined tolerance, and it is determined that the ejection direction of the ink droplet Ip from that nozzle is not proper.

Furthermore, as shown in FIG. 17B, when the flight path F of the ink droplet Ip is within tolerance, the peak value Vmax of the signal waveform of the detection signal from the detection section 80 is within the predetermined tolerance, that is, is between the lower limit value V1 and the upper limit value V2, and it is determined that the ejection direction of the ink droplet Ip from that nozzle is proper.

On the other hand, as shown in FIG. 17C, when the flight path F of the ink droplet Ip is too far away from the sensing section 70, the peak value Vmax of the signal waveform of the detection signal from the detection section 80 falls below the lower limit value V1 of the predetermined tolerance, and it is determined that the ejection direction of the ink droplet Ip from that nozzle is not proper.

It should be noted that information concerning the lower limit value V1 and the upper limit value V2 for prescribing the predetermined tolerance is stored as data in an appropriate storage section such as a memory, which includes the main memory 127 or the EEPROM 129 for example. In comparing the peak value Vmax with the lower limit value V1 and the upper limit value V2, the system controller 126 obtains information concerning the lower limit value V1 and the upper limit value V2 from the appropriate storage section such as the main memory 127 and the EEPROM 129.

Furthermore, whether or not the ejection direction of the ink droplet Ip is proper was determined here based on the peak value Vmax of the output signal from the detection section 80, but there is no limitation to this in the present invention, and any portion of the output signal from the detection section 80 may be used for the determination such as a minimum value of the output signal from the detection section 80, as long as the determination is carried out based on the intensity of the induced current.

<Inspection Procedure>

Figure 18:
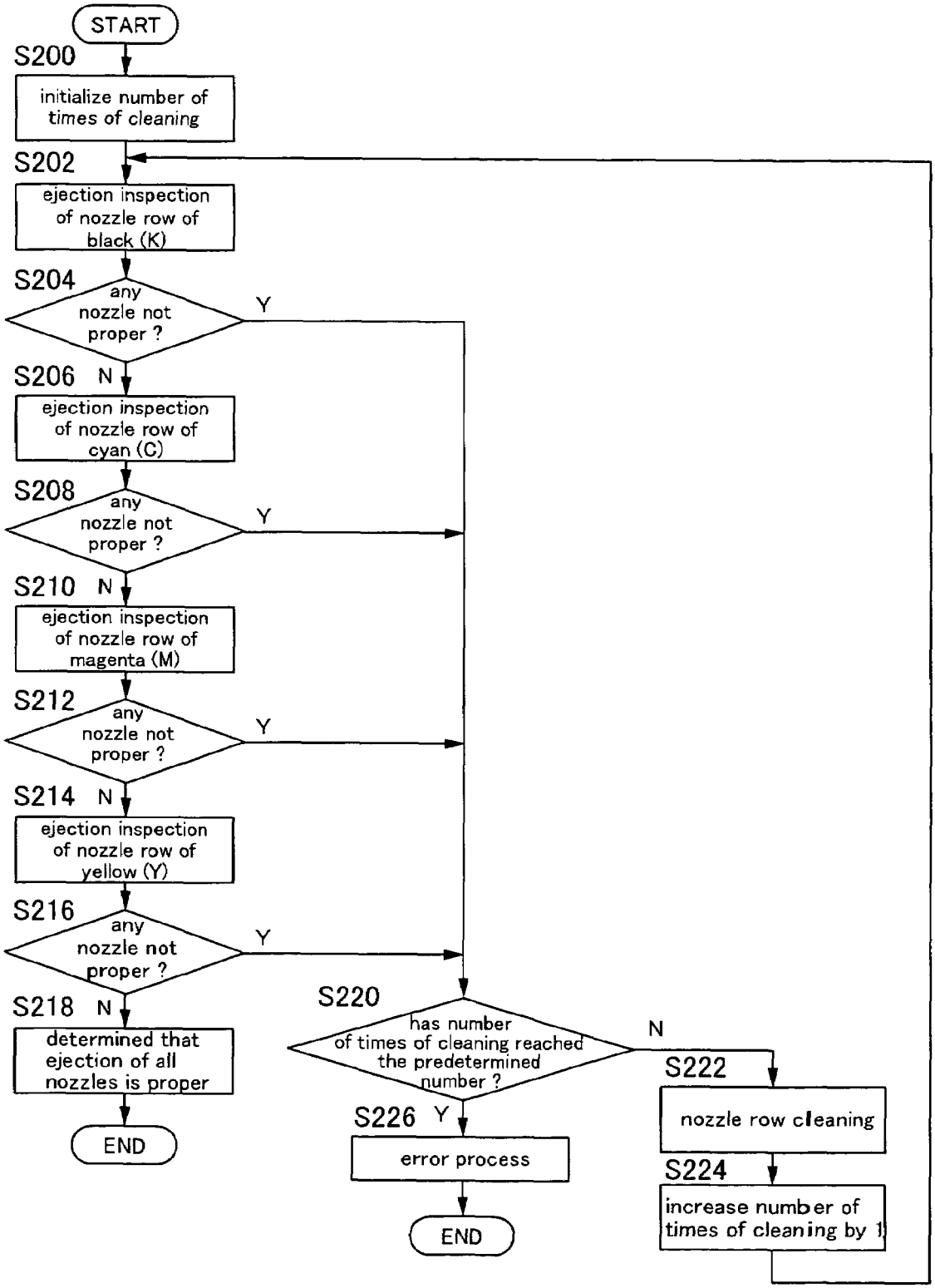
FIG. 18 is a flowchart for describing one embodiment of an inspection procedure.

The inspection procedure is described below. FIG. 18 is a flowchart that illustrates an example of the inspection procedure in the inkjet printer 1 according to the present embodiment. In the present embodiment, the size of the sensing section 70 corresponds only to a one row portion of the nozzle rows 211, and therefore ejection inspection is carried out separately for each of the nozzle rows 211(K), 211(C), 211(M), and 211(Y) by causing the carriage 41 (the head 21) to move with respect to each of the nozzle rows 211(K), 211(C), 211(M), and 211(Y). Here, the ejection inspection is executed in the order of: nozzle row 211(K) of black (K), nozzle row 211(C) of cyan (C), nozzle row 211(M) of magenta (M), and nozzle row 211(Y) of yellow (Y).

First, the number of times of cleaning is initialized (S200). This involves setting to "0" the counter for counting the number of times cleaning was executed during one ejection test, that is, how many times there were nozzles in which the ejection direction was not proper. Following this, ejection inspection is carried out for the nozzle row 211 (K) of black (K) (S202). The ejection inspection that is carried out separately here for the nozzle rows 211(K), 211(C), 211(M), and 211(Y) is described in detail later. After ejection inspection is finished, a check is carried out as to whether or not any nozzle of the nozzles #1 to #180 of the nozzle row 211(K) of black (K) was not proper (S204). Here, it is possible to check whether or not there is any nozzle from which ink was not ejected, and it is also possible to check whether or not there is any nozzle in which the ejection direction of ink was not proper.

Here, even when there is only one nozzle that was not proper of the nozzles #1 to #180 of the nozzle row 211(K) of black (K), a check is carried out as to whether or not the number of times of cleaning has reached a predetermined number (S220). Here, the predetermined number is a number at which it is not conceivable that ejection will be restored even if cleaning is repeated more than this number. For example, if the number of times here is three times and the number of times cleaning has been performed is less than three times, cleaning of the nozzle row 211(K) is performed (S222). The cleaning process here is executed using the pump device 31 for example, and the cleaning may be executed for only the nozzle row 211(K) of black (K), and also another nozzle row may be cleaned at the same time. After cleaning is finished, the number of times of cleaning is increased by one (S224) and ejection inspection of the nozzle row 211(K) is carried out again.

When the number of times of cleaning has reached the predetermined number at step S220, an error process is carried out (S226) and the procedure is ended. The error process here may involve, for example, notifying the user that there is a nozzle which is not proper and suggesting that the user takes the most effective measure for restoring ejection. It is also possible to suggest replacing the head 21, which includes the nozzle that is not proper. Further still, it is also possible to record which nozzle was not proper and to carry out printing without using that nozzle by supplementing with another nozzle.

On the other hand, if all of the nozzles #1 to #180 of the nozzle row 211(K) of black (K) are proper, the procedure proceeds to step S206 and ejection inspection is carried out for the nozzle row 211(C) of cyan (C) (S206). After ejection inspection is finished, a check is carried out as to whether or not any nozzle of the nozzles #1 to #180 of the nozzle row 211(C) of cyan (C) was not proper (S208). Here, it is possible to check whether or not there is any nozzle from which ink was not ejected, and it is also possible to check whether or not there is any nozzle in which the ejection direction of ink was not proper. Here, even when there is only one nozzle that was not proper of the nozzles #1 to #180 of the nozzle row 211(C) of cyan (C), the procedure proceeds to step S220 of checking the number of times of cleaning.

On the other hand, if all of the nozzles #1 to #180 of the nozzle row 211(C) of cyan (C) are proper, the procedure proceeds to the subsequent step S210 and ejection inspection is carried out for the nozzle row 211(M) of magenta (M) (S210). After ejection inspection is finished, a check is carried out as to whether or not any nozzle of the nozzles #1 to #180 of the nozzle row 211(M) of magenta (M) was not proper (S212). Here, it is possible to check whether or not there is any nozzle from which ink was not ejected, and it is also possible to check whether or not there is any nozzle in which the ejection direction of ink was not proper. Here, even when there is only one nozzle that was not proper of the nozzles #1 to #180 of the nozzle row 211(M) of magenta (M), the procedure proceeds to step S220 of checking the number of times of cleaning.

Furthermore, if the ejection directions in the entire nozzle row 211(M) of magenta (M) are proper, the procedure proceeds to the subsequent step S214 and ejection inspection is carried out for the nozzle row 211(Y) of yellow (Y) (S214). After ejection inspection is finished, a check is carried out as to whether or not any nozzle of the nozzles #1 to #180 of the nozzle row 211(Y) of yellow (Y) was not proper (S216). Here, it is possible to check whether or not there is any nozzle from which ink was not ejected, and it is also possible to check whether or not there is any nozzle in which the ejection direction of ink was not proper. Here, even when there is only one nozzle that was not proper of the nozzles #1 to #180 of the nozzle row 211(Y) of yellow (Y), the procedure proceeds to step S220 of checking the number of times of cleaning.

On the other hand, if all of the nozzles #1 to #180 of the nozzle row 211(Y) of yellow (Y) are proper, then, since there is no nozzle that is not proper in the nozzles #1 to #180 of the nozzle rows 211(K), 211(C), 211(M), and 211(Y) of all the colors, a determination is made that "all ejection is proper" (S218) and the process is ended.

Figure 19:
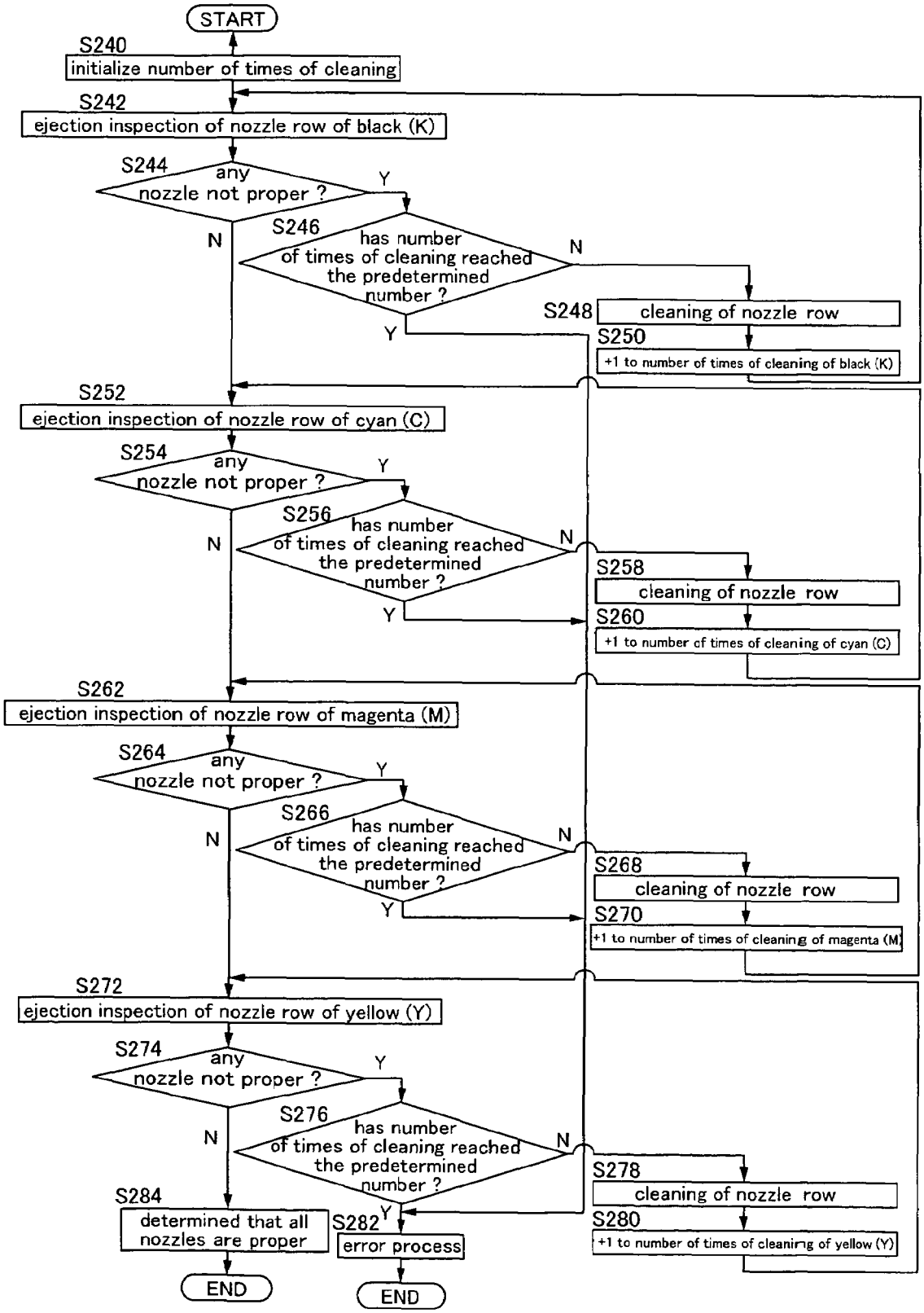
FIG. 19 is a flowchart for describing one embodiment of an inspection procedure.

FIG. 19 is a flowchart showing a case in which cleaning is performed for each of the nozzle rows 211. First, the number of times of cleaning is initialized (S240). This involves setting to "0" all the counters for counting, for each of the nozzle rows 211, the number of times cleaning that was executed during one ejection test, that is, how many times there were nozzles in which the ejection direction was not proper. Following this, ejection inspection is carried out for the nozzle row 211 (K) of black (K) (S242). After ejection inspection is finished, a check is carried out as to whether or not any nozzle of the nozzles #1 to #180 of the nozzle row 211(K) of black (K) was not proper (S244). Here, it is possible to check whether or not there is any nozzle from which ink was not ejected, and it is also possible to check whether or not there is any nozzle in which the ejection direction of ink was not proper.

Here, even if there is only one nozzle that was not proper of the nozzles #1 to #180 of the nozzle row 211(K) of black (K), a check is carried out as to whether or not the number of times of cleaning of the nozzle row 211(K) of black (K) has reached a predetermined number (S246). When the number of times of cleaning is less than the predetermined number, cleaning of the nozzle row 211(K) of black (K) is performed (S248). After cleaning is finished, the number of times of cleaning of the nozzle row 211(K) of black (K) is increased by one time (S250) and ejection inspection of the nozzle row 211(K) of black (K) is carried out again.

When the number of times of cleaning has reached the predetermined number at step S246, an error process is carried out (S282) and the procedure is ended.

On the other hand, if all of the nozzles #1 to #180 of the nozzle row 211(K) of black (K) are proper, the procedure proceeds to step S252 and ejection inspection is carried out for the nozzle row 211(C) of cyan (C) (S252). After ejection inspection is finished, a check is carried out as to whether or not any nozzle of the nozzles #1 to #180 of the nozzle row 211(C) of cyan (C) was not proper (S254). Here, it is possible to check whether or not there is any nozzle from which ink was not ejected, and it is also possible to check whether or not there is any nozzle in which the ejection direction of ink was not proper. Here, even when there is only one nozzle that was not proper of the nozzles #1 to #180 of the nozzle row 211(C) of cyan (C), a check is carried out as to whether or not the number of times of cleaning of the nozzle row 211(C) of cyan (C) has reached the predetermined number (S256). When the number of times of cleaning is less than the predetermined number, cleaning of the nozzle row 211(C) of cyan (C) is performed (S258). After cleaning is finished, the number of times of cleaning of the nozzle row 211(C) of cyan (C) is increased by one time (S260) and ejection inspection of the nozzle row 211(C) of cyan (C) is carried out again.

When the number of times of cleaning has reached the predetermined number at step S256, an error process is carried out (S282) and the procedure is ended.

Following this, the same ejection inspection is executed for magenta (M) and yellow (Y) and even when there is only one nozzle that was not proper of the nozzles #1 to #180, a check is carried out as to whether or not the number of times of cleaning for that nozzle row has reached the predetermined number. When the number of times of cleaning is less than the predetermined number, cleaning is performed and the number of times of cleaning for the that nozzle row is increased by one time, then ejection inspection is again carried out. When the number of times of cleaning has reached the predetermined number, an error process is carried out (S282) and the procedure is ended.

If all of the ejection directions of the nozzles #1 to #180 of the nozzle row 211(Y) of yellow (Y) are proper at step S274, since all the nozzles #1 to #180 in the nozzle rows 211(K), 211(C), 211(M), and 211(Y) of all the colors have proper ejection direction, a determination is made that "all ejection is proper" (S284) and the process is ended.

Figure 20:
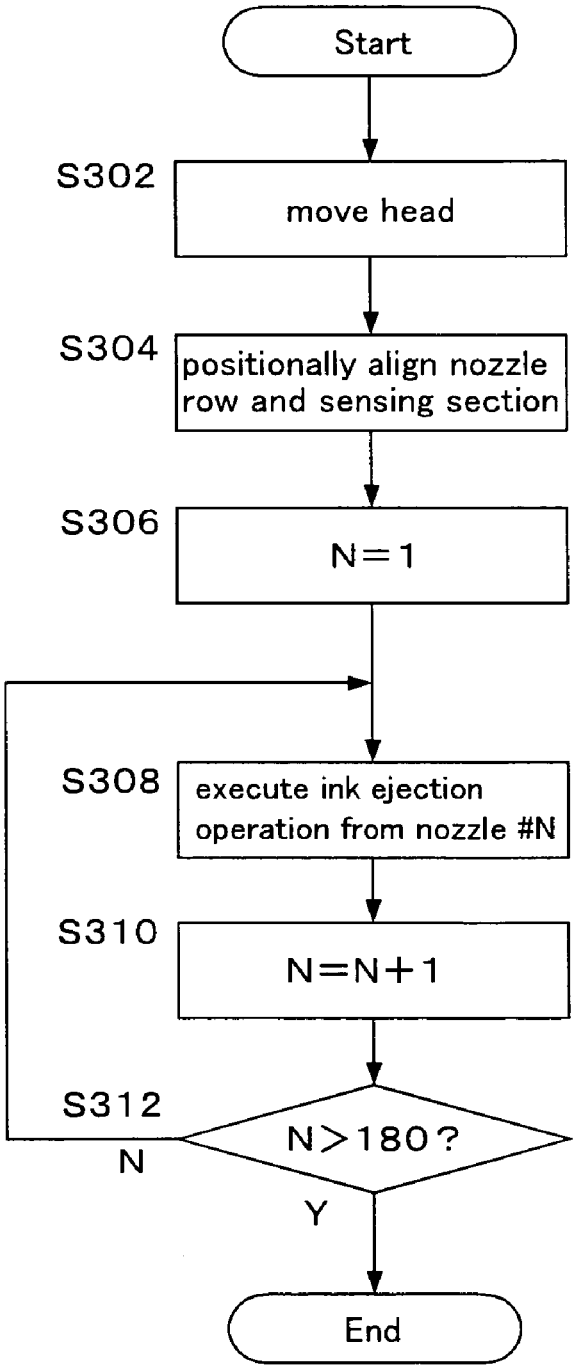
FIG. 20 is a flowchart for describing a procedure in which ejection inspection of the nozzle rows is performed separately.

FIG. 20 is a flowchart that illustrates a procedure of ejection inspection of each of the nozzle rows 211(K), 211(C), 211(M), and 211(Y). First, the head 21 is made to move toward the sensing section 70 (S302). Then, the nozzle row 211 to be inspected and the sensing section 70 are positionally aligned (S304). Next, a variable "EN" is set to an initial value "1" (S306) and an operation is executed in which a one-time portion (one droplet portion) of the ink droplet Ip is ejected from the "N"th nozzle (nozzle #N) toward the sensing section 70 to carry out ejection inspection (S308). After ejection has finished, the variable "N" is incremented to a value of "N+1" (S310) and a check is carried out as to whether or not the variable "N" has exceeded "180", which is the number of nozzles (S312). When the variable "N" exceeds "180" here, this means that ejection inspection is finished for all the nozzles, and processing is finished.

On the other hand, if the variable "N" has not exceeded "180," this means that ejection inspection has not finished for all the nozzles #1 to #180 and the procedure returns to step S308, with an ink ejection operation being executed for the next "N+1" number nozzle (nozzle #N+1) to carry out ejection inspection (S308). After this, the variable "N" is again set to a value of "N+1" (S310) and ejection inspection is executed in order for each of the nozzles #1 to #180 until the variable "N" exceeds "180," which is the number of nozzles.

It should be noted that, in the present embodiment, this series of inspection processes is executed by the system controller 126 based on a program that is read from the main memory 127 or the EEPROM 129 for example, or executed by commands from the host computer 140.

On the other hand, based on the output signal from the detection section 80, the system controller 126 performs sequential analysis on the induced current produced in the sensing section 70 by the ink droplets Ip that are ejected from the nozzles #1 to #180. The system controller 126 then makes successive determinations as to whether or not the individual ejection from each of the respective nozzles #1 to #180 is proper. Here, it is possible to determine the presence/absence of ejection from each of the respective nozzles #1 to #180 and it is also possible to determine whether or not the ejection direction of each of the respective nozzles #1 to #180 is proper.

Figure 21:
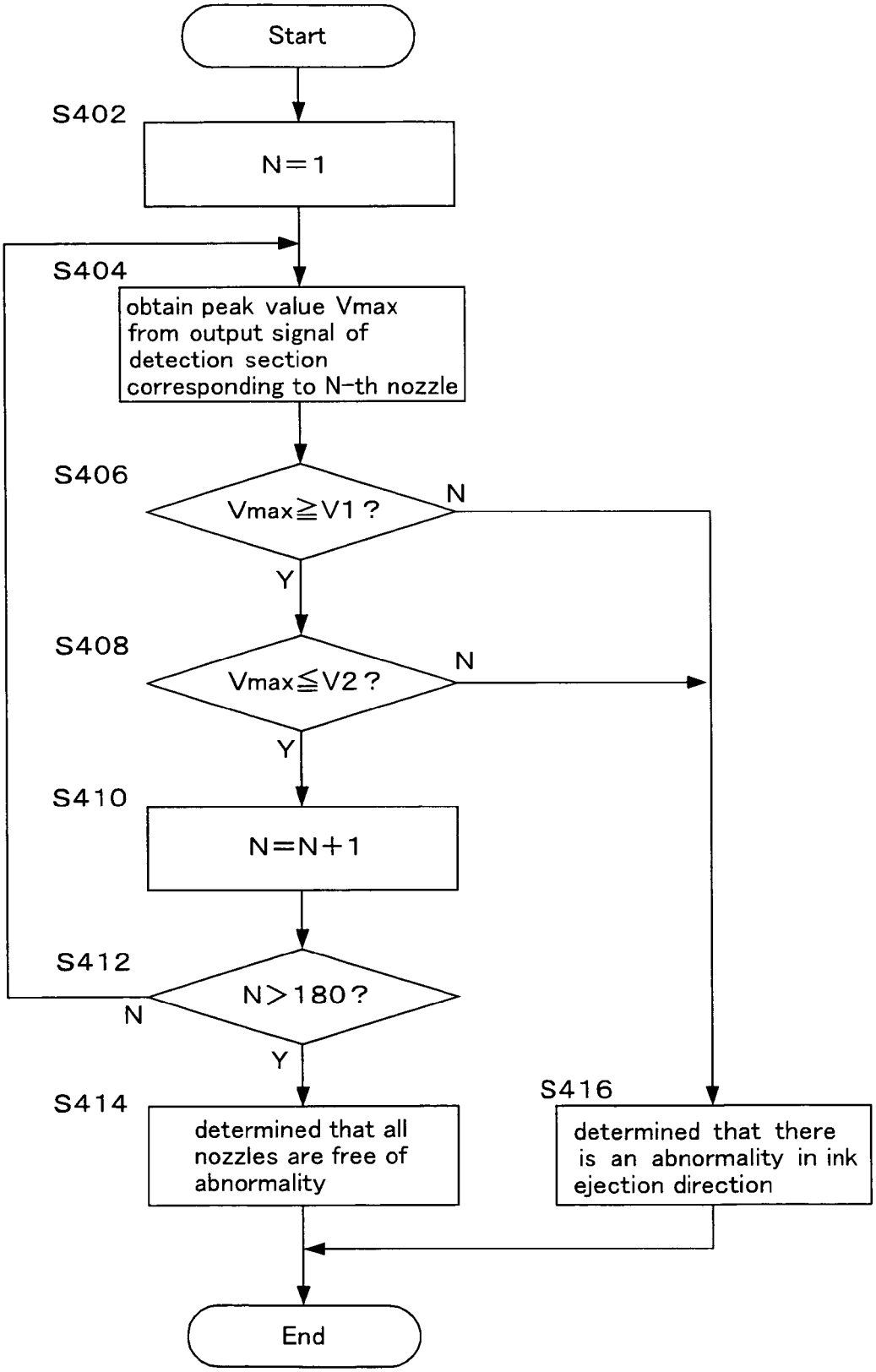
FIG. 21 is a flowchart illustrating an example of a determination procedure.

FIG. 21 is a flowchart that illustrates an example of the procedure for determining the ejection direction using the system controller 126. The system controller 126 sets the variable "N" to an initial value of "1" (S402). Next, the system controller 126 obtains the peak value Vmax of the waveform Wb from the output signal from the detection section 80 corresponding to the "N"th nozzle (nozzle #N) (S404). Next, the system controller 126 checks whether or not the peak value Vmax that has been obtained is equal to or above the lower limit value V1 of the predetermined tolerance (S406). If the peak value Vmax here falls below the lower limit value V1, that is, if the peak value Vmax is out of the predetermined tolerance, a determination is made that there is an abnormality in the ejection direction of the ink (S416), and the process is immediately ended.

On the other hand, if the peak value Vmax is equal to or above the lower limit value V1, the system controller 126 next checks whether or not the peak value Vmax is equal to or below the upper limit value V2 of the predetermined tolerance (S408). If the peak value Vmax here exceeds the upper limit value V2, that is, if the peak value Vmax is out of the predetermined tolerance, a determination is made that there is an abnormality in the ejection direction of the ink (S416), and the process is immediately ended.

On the other hand, if the peak value Vmax is equal to or below the upper limit value V2, the system controller 126 determines that there is no abnormality in the ejection direction of the ink with regard to the "N"th nozzle (nozzle #N), that is, that the ejection direction of the ink is proper, and the variable "N" is set to a value of "N+1" (S410), so as to carry out a determination of the next nozzle. The system controller 126 then checks whether or not the variable "N" that has been set exceeds "180," which is the number of nozzles (S412). If the variable "N" exceeds "180" here, the system controller 126 assumes that the inspection for all the nozzles in that particular nozzle row 211 is finished, and the procedure advances to step S414, where it is determined that there is no nozzle in that nozzle row 211 having an abnormality in the ejection direction of the ink (S414), and the process is immediately ended.

Timing of Inspection

The timing by which ejection inspection is carried out may be as follows.

(1) During Printing

Ejection inspection is executed at appropriate times during printing. For example, in the case of "bi-directional printing," ejection inspection of the nozzles #1 to #180 is executed by moving the carriage 41 to a standby position when the movement direction changes. In this way, it is possible to avoid problems being caused in the printed image due to clogging of the nozzles for example midway during printing.

(2) When the Power is Turned On

Ejection inspection is executed when the power is turned on. This involves executing ejection inspection when the power of the printer (printing apparatus) is turned on in order to carry out printing from that point of time, and ejection inspection of the nozzles #1 to #180 is executed as one of the processes that are carried out during initialization of the printer 1. By carrying out ejection inspection at this timing, printing can be executed smoothly without clogging or the like of the nozzles #1 to #180.

(3) During Paper Supply

Ejection inspection is executed during an operation in which the medium S is fed to a predetermined position for printing, that is, during paper supply. This involves checking whether or not ink is being properly ejected during the time when a printing process is about to be executed for the next medium S; it may be possible to carry out ejection inspection each time the medium S is supplied, or it may be also possible to carry out ejection inspection for every predetermined number of media at an appropriate interval.

(4) At the Time of Obtaining Print Data

Ejection inspection is executed during the time when the printer 1 has received print data from the host computer 140 such as a personal computer. That is, a check is carried out as to whether or not ink is being ejected properly at the time when print data is received from the host computer 140 and the next printing is about to be executed. By carrying out ejection inspection at this time, printing can be executed smoothly without clogging or the like of the nozzles #1 to #180.

It should be noted that the ejection inspection carried out in the present invention does not necessarily have to have the aforementioned timings (1) to (4), and ejection inspection may also be executed at timings other than those of (1) to (4).

<Summary>

With the above-described apparatus for inspecting liquid ejection, determination of the presence/absence of ink ejection from the nozzles #1 to #180 is made by carrying out an operation in which electrically-charged ink is ejected from the nozzles #1 to #180 of the head 21 and examining whether or not an induced current is produced in the sensing section 70, and therefore ejection inspection can be carried out extremely easily. Accordingly, the device structure is extremely compact, does not require a large installation space, and can be achieved without incurring greatly increased costs.

Furthermore, it is possible to examine the distance between the flight path of the ink droplet Ip and the sensing section 70 by detecting the intensity of the induced current produced in the sensing section 70, such that it is possible to easily determine whether or not the ejection direction of the ink droplet Ip ejected from the nozzles #1 to #180 is proper. In this way, the device structure is extremely compact, does not require a large installation space, and can be achieved without incurring greatly increased costs.

Furthermore, by installing the apparatus for inspecting liquid ejection in a liquid ejecting apparatus such as the above-mentioned inkjet printer 1, it is possible to carry out ejection inspection extremely easily, and ejection irregularities can be solved easily without much time and effort.

Furthermore, since ink does not have to make contact with the sensing section 70, it is possible to prevent ink scattering and rebounding during ejection inspection, and in this way it is possible to avoid soiling the inside of the apparatus with ink.

Furthermore, since ink does not have to make contact with the sensing section 70, there is no need to achieve a precise positional alignment between the nozzle row and the sensing section.

Furthermore, by using a wire material to form the sensing section 70 as in the present embodiment, even if ink ejected from the nozzles #1 to #180 adheres to the sensing section 70, the ink can be easily removed. In this way, there is no particular need for any cleaning mechanism to remove ink from the sensing section 70.

OTHER EMBODIMENTS INSPECTING APPARATUSES <No. 1>

Figure 22A:
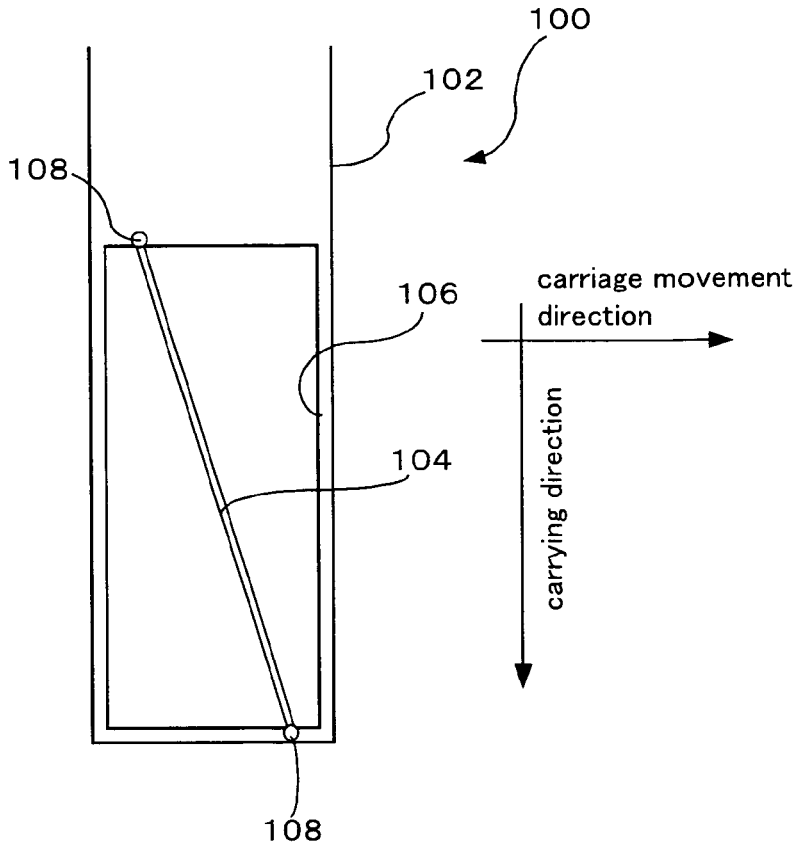
FIG. 22A is a plan view for describing another embodiment of an apparatus for inspecting liquid ejection.
Figure 22B:
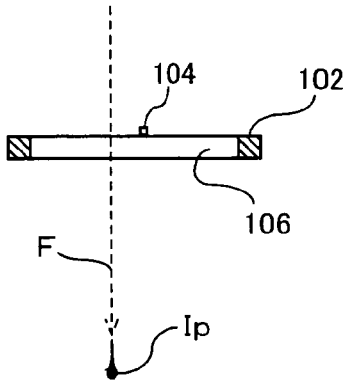
FIG. 22B is a vertical cross sectional view for describing another embodiment of an apparatus for inspecting liquid ejection.
Figure 23:
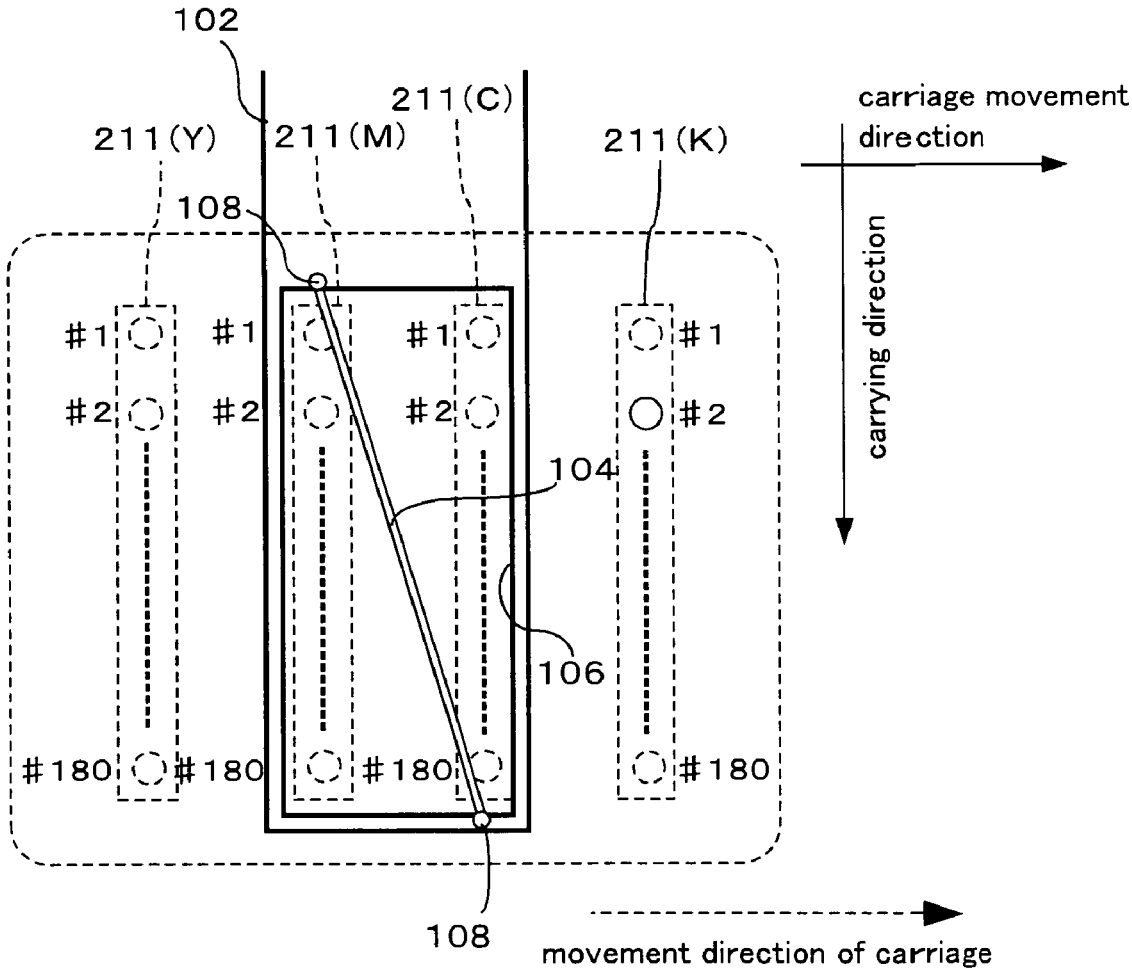
FIG. 23 is an explanatory diagram illustrating one embodiment when ejection inspection is carried out using the apparatus for inspecting liquid ejection described in FIGS. 22A and 22B.

FIG. 22A, FIG. 22B, and FIG. 23 illustrate other embodiments of apparatuses for inspecting liquid ejection according to the present invention. FIG. 22A is a plan view showing an exterior view of a sensing section 104 according to another embodiment, and FIG. 22B is a vertical cross sectional view thereof. FIG. 23 is a diagram illustrating a method when ejection inspection is carried out using this apparatus for inspecting liquid ejection.

As shown in FIGS. 22A and 22B, a liquid ejection inspecting apparatus 100 is provided with the sensing section 104 arranged on a rectangular-shaped substrate 102. The sensing section 104 is formed using a wire material formed using a conductor such as a metal, and is arranged spanning obliquely (diagonally) with respect to the movement direction of the carriage 41 on an aperture portion 106 that is formed at a front end area (lower end area) of the substrate 102. Both ends of the sensing section 104 are fixed by a respective fixing member 108 at an inner edge of the aperture portion 106, and the sensing section 104 is arranged stretched over the aperture portion 106.

As shown in FIG. 23, when using this inspecting apparatus 100 to carry out inspection of the nozzles #1 to #180 of the nozzle rows 211, the ink droplets Ip are successively ejected from the nozzles #1 to #180 toward the sensing section 104 or its vicinity while the carriage 41 is caused to move slowly over across the liquid ejection inspecting apparatus 100 at a predetermined velocity.

The ink droplets Ip ejected from the nozzles #1 to #180 pass the side of the sensing section 104 through the aperture portion 106 of the substrate 102 to drop below and are recovered in the ink recovery section 90 (see FIG. 14) for example.

By arranging the sensing section 104 of the liquid ejection inspecting apparatus 100 obliquely with respect to the movement direction of the carriage 41 in this way, it is possible to detect displacement in the ejection direction of the ink droplets Ip in a direction that intersects the movement direction of the carriage 41, for example, the carrying direction of the medium S. That is to say, in the foregoing embodiment, the sensing section 70 was arranged in a direction perpendicular to the movement direction of the carriage 41, and therefore when the ejection direction of the ink droplet Ip ejected from the nozzles #1 to #180 was displaced in the arrangement direction of the sensing section, that is, in the carrying direction of the medium S, such displacement could not be detected. However, as described here, by arranging the sensing section 104 diagonally with respect to the movement direction of the carriage 41, it is possible to detect such displacement even when the ejection direction of the ink is displaced in the carrying direction of the medium S.

Being able to detect displacement in the ejection direction of the ink droplets Ip in the carrying direction of the medium S makes it possible to prevent the occurrence of "white stripes" that occur along the movement direction of the carriage 41, this being a major cause of deterioration in image quality in printed images.

It should be noted that it is not necessarily required to move the carriage 41 at a predetermined velocity, that is, a fixed speed, when ejecting the ink droplets Ip in order from the nozzles #1 to #180 while moving the carriage 41, and it is possible to repetitively move and stop the carriage 41 each time an ink droplet Ip is ejected from the nozzles #1 to #180 for inspection.

OTHER EMBODIMENTS OF INSPECTING APPARATUSES <No. 2>

Figure 24:
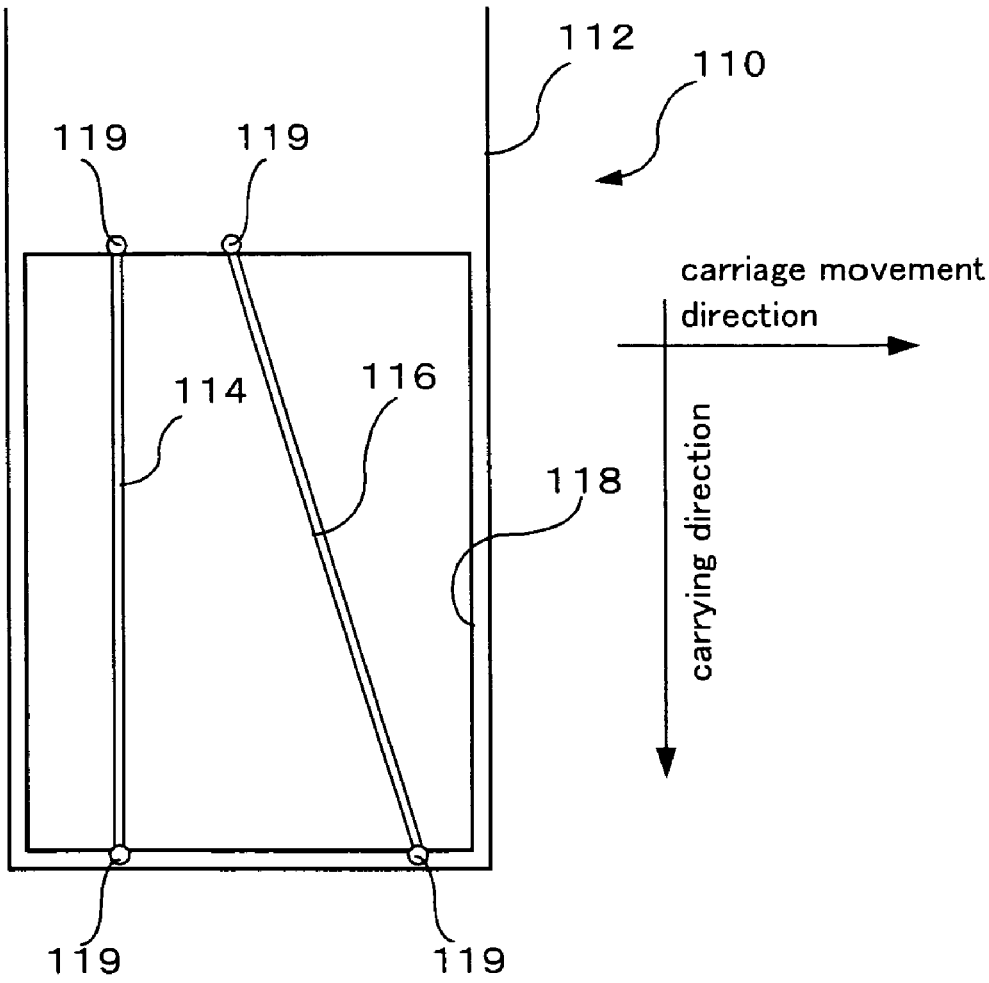
FIG. 24 is an explanatory diagram illustrating another embodiment of an apparatus for inspecting liquid ejection.

FIG. 24 illustrates another embodiment of an apparatus for inspecting liquid ejection according to the present invention. As shown in this diagram, a liquid ejection inspecting apparatus 110 is provided with two sensing sections 114 and 116 arranged on a substrate 112. The sensing sections 114 and 116 are respectively formed using a wire material formed using a conductor such as a metal, and are arranged in a state of tension spanning an aperture portion 118 that is formed at a front end area (lower end area) of the substrate 112. The one sensor 114 is arranged in a direction perpendicular to the movement direction of the carriage 41, and the other sensor 116 is arranged diagonally with respect to the movement direction of the carriage 41. Both ends of the sensing sections 114 and 116 are fixed by respective fixing members 119 at inner edges of the aperture portion 118.

By providing two sensing sections 114 and 116 arranged in a non-parallel arrangement in this way, namely, the two types of the sensing sections 114 and 116 being the sensing section 114, which is arranged in a direction perpendicular to the movement direction of the carriage 41, and the sensor 116, which is arranged diagonally with respect to the movement direction of the carriage 41, it is possible to let the sensors mutually complement each other and detect displacement of the ejection direction of the ink droplet Ip in directions that each of the sensing sections 114 and 116 cannot detect individually. In this way, it is possible to reliably check displacement in the ejection direction of the ink of the nozzles #1 to #180.

In this case, either of the sensing sections 114 and 116 of the two sensing sections 114 and 116 may be used first to carry out inspection when inspecting the nozzles #1 to #180 of a particular nozzle row 211.

OTHER EMBODIMENTS OF INSPECTING APPARATUSES <No. 3>

Figure 25:
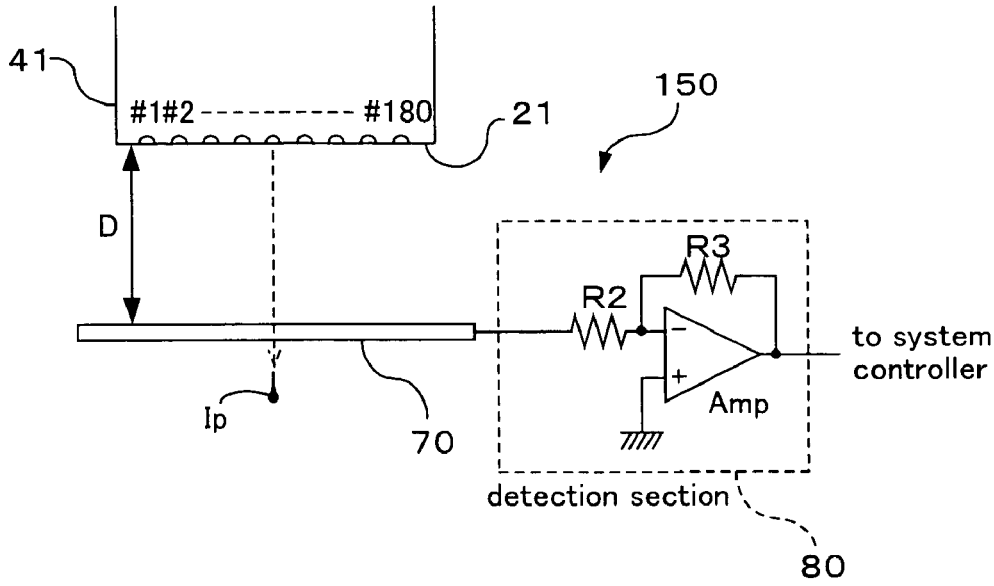
FIG. 25 is an explanatory diagram illustrating another embodiment of an apparatus for inspecting liquid ejection.

FIG. 25 illustrates another structural example of an apparatus for inspecting liquid ejection according to the present invention. As shown in the diagram, this inspecting apparatus 150 does not cause the ink droplet Ip ejected from the nozzles #1 to #180 to become charged by applying a high voltage to the sensing section 70 in which an induced current is produced as in the previously described apparatus for inspecting liquid ejection (see FIGS. 9 and 10), but rather causes the ink droplet Ip to become charged by charging naturally using a so-called frictional electrification phenomenon when the ink droplet Ip that is ejected from the nozzles #1 to #180 moves apart from the nozzles #1 to #180. For this reason, a structure that applies a high voltage to the sensing section 70 for charging the ink droplet Ip can be omitted.

By causing the ink droplets Ip that are ejected from the nozzles #1 to #180 to become charged using frictional electrification in this way, it is possible to simplify the structure of the liquid ejection inspecting apparatus 150.

It should be noted that the capacitor C provided in the detection section 80 of the liquid ejection inspecting apparatus 60 (see FIGS. 9 and 10) that was previously described is omitted from the configuration in this apparatus for inspecting liquid ejection because a high voltage is not applied to the sensing section 70.

OTHER EXAMPLE CONFIGURATIONS OF INSPECTING APPARATUSES <No. 3>

Figure 26:
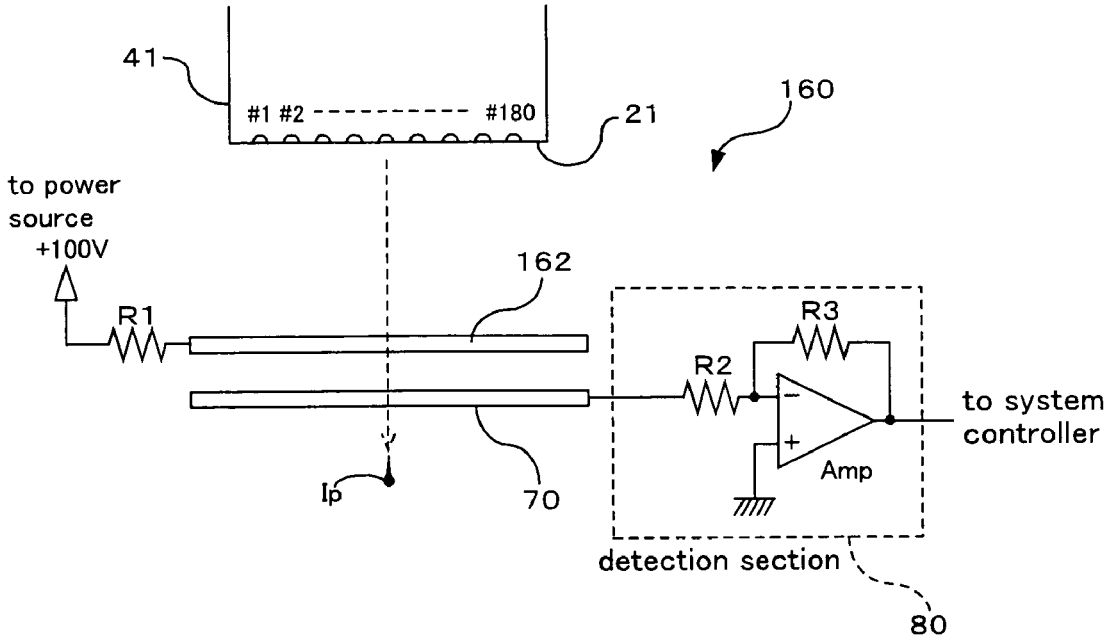
FIG. 26 is an explanatory diagram illustrating another embodiment of an apparatus for inspecting liquid ejection.

FIG. 26 illustrates another structural example of an apparatus for inspecting liquid ejection according to the present invention. As shown in the diagram, an inspecting apparatus 160 is provided with an electrode section 162 separately from the sensing section 70, and the ink droplets Ip ejected from the nozzles #1 to #180 are charged by the electrode section 162. As shown in the diagram, like the sensing section 70, the electrode section 162 is made of a conductive wire material such as a metal and is positioned in parallel to the head 21 in a form that has been stretched into a state of tension. A power source (not shown) is connected to the electrode section 162 via the protective resistor R1, and is configured so as to be supplied with a high voltage of +100V (volts) for example from the power source.

An electric field is formed between the head 21 and the electrode section 162 by arranging the electrode section 162, and therefore it is possible to charge the ink droplets Ip when they move apart from the nozzles #1 to #180.

Figure 27A:
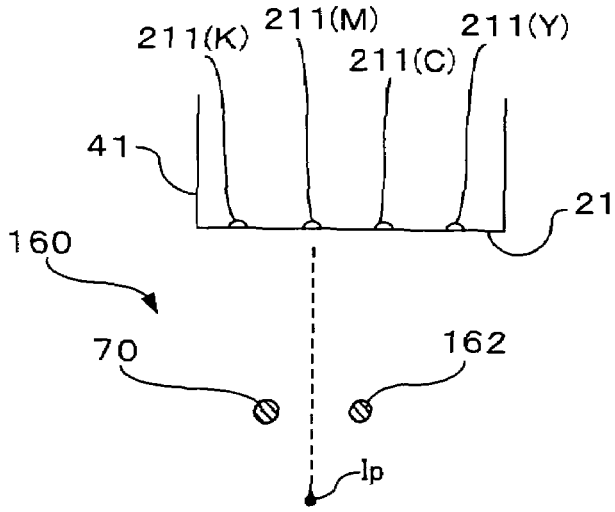
FIG. 27A illustrates an example in which the electrode section is installed to the side of the sensing section.
Figure 27B:
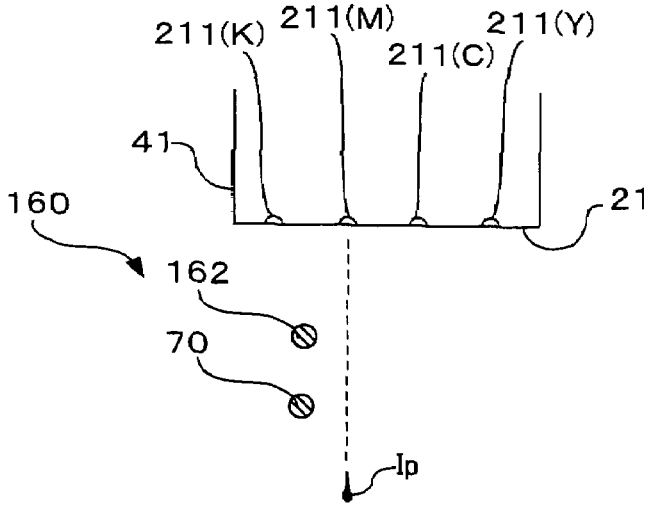
FIG. 27B illustrates an example in which the electrode section is installed above the sensing section.

An installation position of the electrode section 162 is described next. FIGS. 27A and 28B respectively illustrate installation positions of the electrode section 162. FIG. 27A illustrates an example where the electrode section 162 is installed to the side of the sensing section 70. FIG. 27B illustrates an example where the electrode section 162 is installed above the sensing section 70.

As shown in FIG. 27A, when the electrode section 162 is positioned to the side of the sensing section 70, the electrode section 162 is positioned parallel to the sensing section 70 with a spacing between the electrode section 162 and the sensing section 70. The ink droplet Ip that has been ejected from the nozzles #1 to #180 drops downward and passes between the electrode section 162 and the sensing section 70. By positioning the electrode section 162 in this way, it is possible to attach the electrode section 162 to the substrate 72 in a similar manner as the sensing section 70.

Figure 28A:
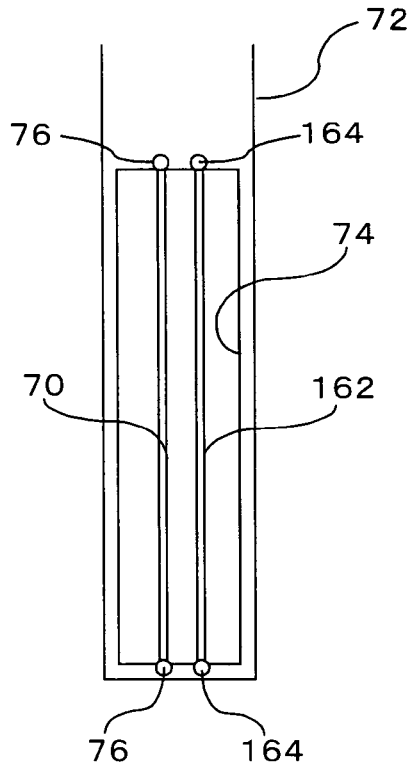
FIG. 28A is a plan view of when the electrode section and the sensing section are both attached to the substrate.
Figure 28B:
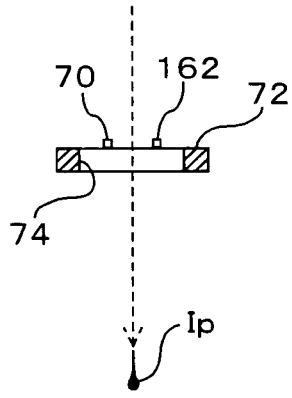
FIG. 28B is a vertical cross sectional view of when the electrode section and the sensing section are both attached to the substrate.

FIG. 28A is a plan view of when the electrode section 162 and the sensing section 70 are both attached to the substrate 72. FIG. 28B is a vertical cross sectional view of when the electrode section 162 and the sensing section 70 are both attached to the substrate 72. As shown in these diagrams, the electrode section 162 is positioned parallel to the sensing section 70 above an aperture portion of the substrate 72, spanning it lengthwise. Both ends of the electrode section 162 are fixed to the substrate 72 by fixing members 164.

Similarly, when the electrode section 162 is positioned above the sensing section 70 as shown in FIG. 27B, the electrode section 162 is positioned parallel to the sensing section 70 with a spacing between the electrode section 162 and the sensing section 70. However, in this case, the ink droplet Ip passes the side of the electrode section 162 and the sensing section 70. By positioning the electrode section 162 above the sensing section 70 in this way, it is possible to bring the electrode section 162 closer to the head 21, and this makes it possible to increase the intensity of the electric field that is formed between the head 21 and the electrode section 162, and the ink droplets Ip ejected from the nozzles #1 to #180 of the head 21 can be more easily charged. That is, the ink droplets Ip can be more easily sensed by the sensing section 70.

It should be noted that it is preferable that the installation position of the electrode section 162 is as close as possible to the head 21. The closer the electrode section 162 can be brought to the head 21, the stronger the electric field can be made between the electrode section 162 and the head 21, and this allows the sensing section 70 to perform sensing even more easily.

OTHER EMBODIMENTS OF THE SENSING SECTION

Figure 29A:
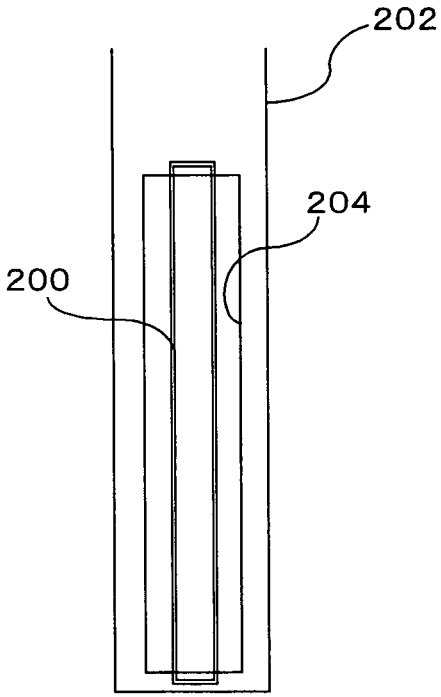
FIG. 29A is a plan view of a substrate on which a sensing section of the present invention is attached.
Figure 29B:
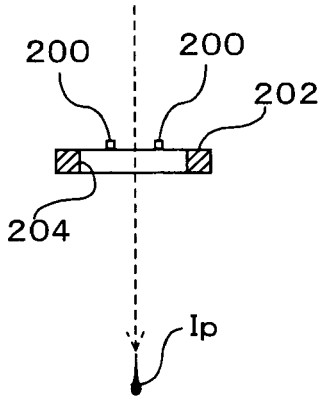
FIG. 29B is a vertical cross sectional view of that substrate.

FIGS. 29A and 29B are explanatory diagrams illustrating another embodiment of the sensing section according to the present invention. FIG. 29A is a plan view of a substrate 202 on which a sensing section 200 is attached. FIG. 29B is a vertical cross sectional view of the substrate 202 on which the sensing section 200 is attached. The sensing section 200 is provided in a coil shape on the substrate 202 formed rectangularly, and spans the aperture portion 204 formed on a front end area of the substrate 202 such that it crosses over the aperture longitudinally. The ink droplets Ip ejected respectively from each of the nozzles #1 to #180 of the head 21 drop downward passing through a central area of the coil shaped sensing section 200.

Compared to the linearly shaped sensing section 70 of the apparatus for inspecting liquid ejection described earlier, by forming the sensing section 200 in a coil shape in this way so that the ink droplets Ip drop through a central area of the coil shaped sensing section 200, it is possible to produce an even larger induced current, and therefore it is possible to perform sensing of the ink droplet Ip with even greater accuracy.

Moreover, the greater the number of windings of the coil in the sensing section 200, the greater the sensing accuracy that can be achieved.

Figure 30A:
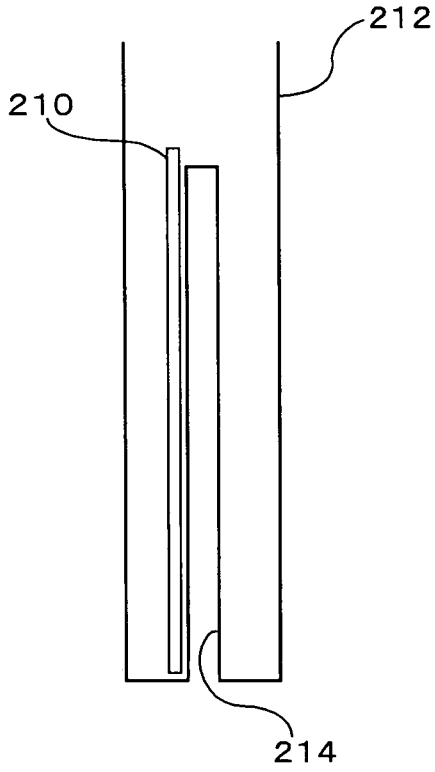
FIG. 30A is a plan view of a substrate on which a sensing section of the present invention is attached.
Figure 30B:
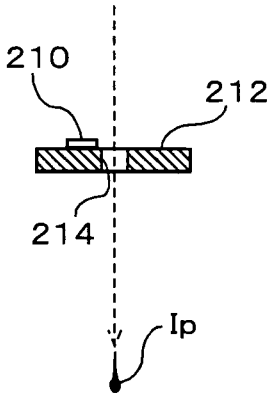
FIG. 30B is a vertical cross sectional view of that substrate.

Further still, FIGS. 30A and 30B are explanatory diagrams illustrating another embodiment of the sensing section according to the present invention. FIG. 30A is a plan view of a substrate 212 on which a sensing section 210 is attached. FIG. 30B is a vertical cross sectional view of the substrate 212 on which the sensing section 210 is attached. The sensing section 210 is formed as a board-shaped thin layer on the substrate 212; for example, it is formed on the substrate 212 by a direct application of a metal, or formed by using a deposition technique such as vapor deposition. A slit-shaped aperture portion 214 is provided in the vicinity of the sensing section 210 to allow ink droplets Ip ejected from the nozzles #1 to #180 to pass through.

It should be noted that, similar to the sensing section 210, the electrode section 162 of the present invention may also be provided as a board-shaped thin layer that is formed on the substrate 212 by a direct application of a metal board for example, or by using a deposition technique such as vapor deposition.

<Water Repellent Treatment>

It is also possible to subject the surfaces of the sensing sections 70, 104, 114, 116, 200, and 210 of the present invention to a water repellent treatment. By applying water repellent treatment on the surfaces of the sensing sections 70, 200, and 210, even if the ink droplets Ip ejected from the nozzles #1 to #180 come into contact with the sensing sections 70, 104, 114, 116, 200, and 210, the ink can be easily removed from the surface of the sensing sections 70, 104, 114, 116, 200, and 210.

Furthermore, a water repellent treatment may be similarly applied to the surface of the electrode section 162 of the present invention. By applying water repellent treatment to the surface of the electrode section 162 also, even if the ink droplets Ip ejected from the nozzles #1 to #180 adhere to the electrode section 162, the ink can be easily removed from the surface of the electrode section 162.

Examples of methods for applying a water repellent treatment on the surfaces of the sensing sections 70, 104, 114, 116, 200, and 210 and the electrode section 162 include a method in which a water repellent layer is provided by coating or the like for example, as well as other commonly known methods.

Configuration of the Liquid Ejection System etc.

The following is a description of an example of a liquid ejection system according to the present invention, described taking, as an example, a liquid ejecting system provided with an inkjet printer as a liquid ejecting apparatus.

Figure 31:
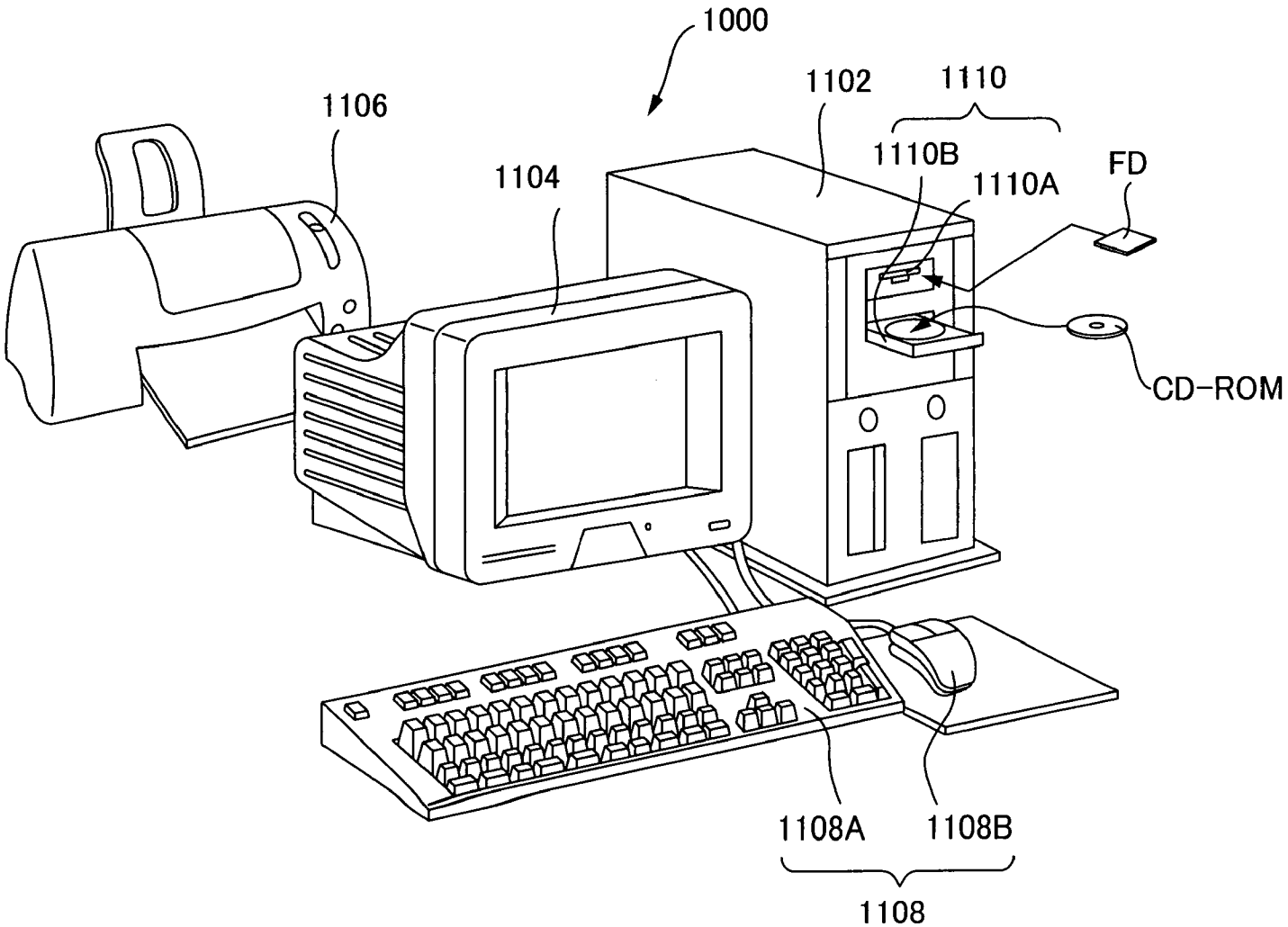
FIG. 31 is a perspective view for describing one embodiment of a liquid ejection system.

FIG. 31 is an explanatory diagram showing the external structure of the liquid ejection system. A liquid ejection system 1000 is provided with a computer 1102, a display device 1104, a printer 1106, input devices 1108, and a reading device 1110. In this embodiment, the main computer unit 1102 is accommodated within a mini-tower type housing; however, there is no limitation to this. A CRT (cathode ray tube), plasma display, or liquid crystal display device, for example, is generally used as the display device 1104, but there is no limitation to this. The printer 1106 is the printer described above. In this embodiment, the input devices 1108 are a keyboard 1108A and a mouse 1108B, but there is no limitation to these. In this embodiment, a flexible disk drive device 1110A and a CD-ROM drive device 1110B are used as the reading device 1110, but the reading device 1110 is not limited to these, and it may also be an MO (magnet optical) disk drive device or a DVD (digital versatile disk), for example.

Figure 32:
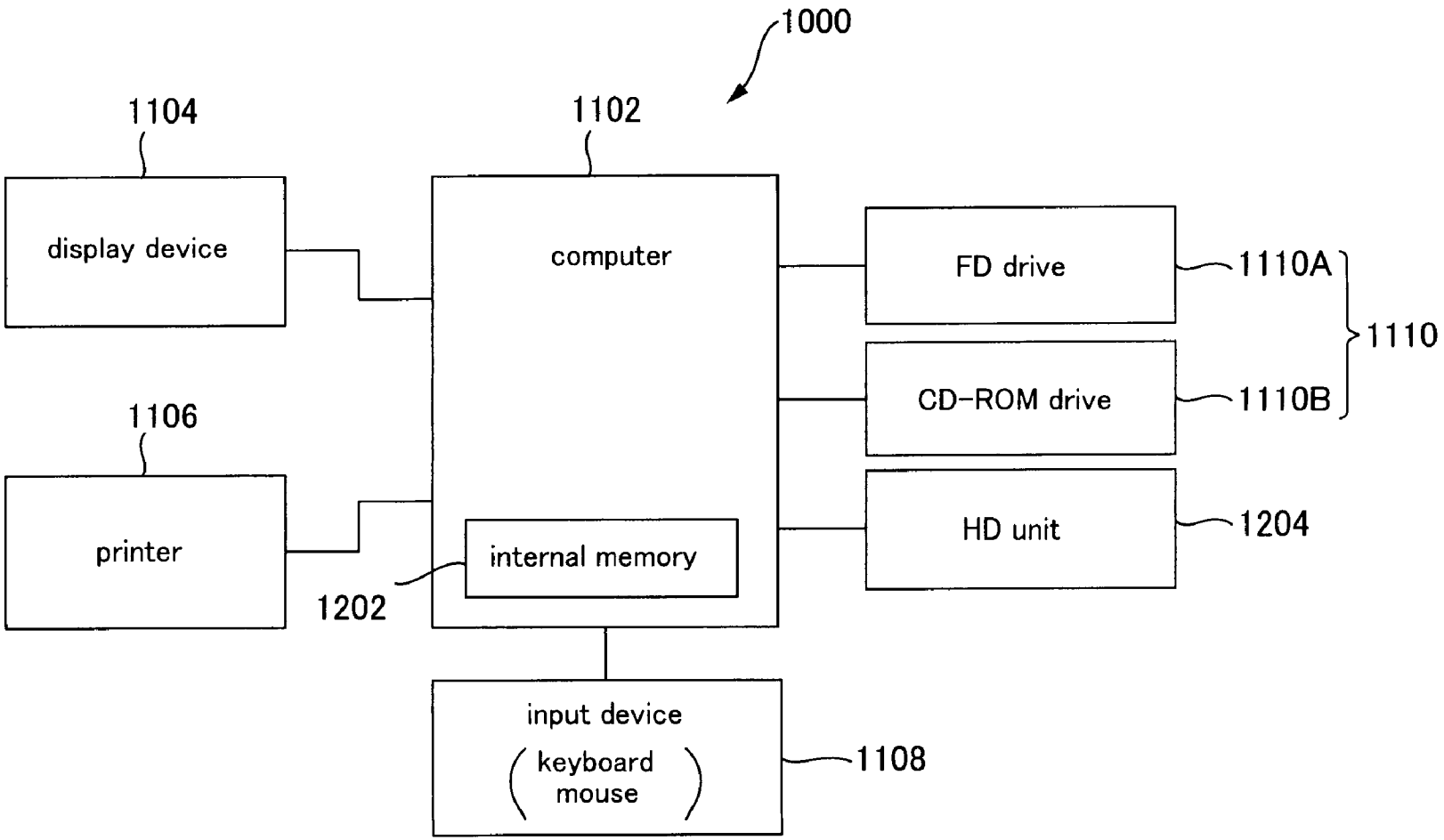
FIG. 32 is a block configuration diagram showing the configuration of the liquid ejection system shown in FIG. 31.

FIG. 32 is a block diagram showing the configuration of the liquid ejection system shown in FIG. 31. An internal memory 1202 such as a RAM is provided within the housing accommodating the main computer unit 1102, and also an external memory such as a hard disk drive unit 1204 is provided.

A computer program for controlling the operation of the above printer 1 can be downloaded onto the computer system 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read by various types of reading devices 1110.

In the above description, an example was described in which the liquid ejection system is constituted by connecting the printer 1106 to the main computer unit 1102, the display device 1104, the input device 1108, and the reading device 1110; however, there is no limitation to this. For example, the liquid ejection system can be made of the main computer unit 1102 and the printer 1106, or the liquid ejection system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. For example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As an overall system, the liquid ejection system that is thus achieved is superior to conventional systems.

OTHER EMBODIMENTS

In the foregoing, a printing apparatus, for example, was described based on an embodiment thereof. However, the foregoing embodiment is for the purpose of elucidating the present invention and is not to be interpreted as limiting the present invention. The invention can of course be altered and improved without departing from the gist thereof and includes equivalents. In particular, the embodiments described below are also included in the apparatus for inspecting liquid ejection and the liquid ejecting apparatus according to the present invention.

Further, some or all of the configurations achieved by hardware in the foregoing embodiment may be replaced by software, and conversely, some of the configurations that are achieved by software can be replaced by hardware.

It is possible to perform some of the processes that are performed on the liquid ejecting apparatus (inkjet printer 1) side on the host computer 140 side instead, and it is also possible to provide a dedicated processing device between the liquid ejecting apparatus (inkjet printer 1) and the host computer 140 and make this processing device perform some of the processes.

<Regarding the Liquid>

In the foregoing embodiments, description was given using ink as an example of a liquid, but the liquid ejecting apparatus according to the present invention is not limited to ink, and instead of ink, may use various other types of liquid such as a metal material, an organic material (a macromolecule material for example), a magnetic material, a conductive material, a wiring material, film-forming material, electronic ink, various processing liquids, and genetic solutions.

<Regarding the Nozzles>

In the foregoing embodiments, the nozzles #1 to #180 constituting a nozzle row 211 of the head 21 of the inkjet printer 1 were given as an example of a nozzle, but the nozzle of the present invention is not limited to the nozzles #1 to #180 constituting a nozzle row 211, and may be any form of nozzle as long as it ejects a liquid.

<Regarding the Sensing Section>

In the foregoing embodiments, the sensing sections 70, 104, 114, and 116, which are made of a wire material, the sensing section 200, which is formed in a coil shape, and the thin layer shaped sensing section 210 were described as examples of the sensing section of the present invention, but the sensing section of the present invention is not limited to the sensing sections 70, 104, 114, 116, 200, and 210, and sensors of other shapes and other types may be used.

Furthermore, in the foregoing embodiments, the sensing sections 70, 104, 114, 116, 200, and 210 arranged on the substrates 72, 102, 112, 202, and 212 were described as examples of the sensing section of the present invention, but it is not necessarily required for the sensing section of the present invention to be arranged on the substrates 72, 102, 112, 202, and 212, and they may be arranged in other forms.

<Regarding the Detection Section>

In the foregoing embodiments, the detection section 80, which detects current fluctuation of the sensing sections 70, 104, 114, 116, 200, and 210, was described as an example of the detection section of the present invention, but the detection section of the present invention is not limited to the detection section 80, and any other type of detection section may be used as long as it is capable of detecting whether or not an induced current has been produced in the sensing sections 70, 104, 114, 116, 200, and 210 due to an electrically-charged liquid (ink) ejected from the nozzles #1 to #180.

<Regarding the Electrode Section>

In the foregoing embodiments, the electrode section 162 formed using a wire material was described as an example of the electrode section of the present invention, but the electrode section of the present invention is not limited to the electrode section 162 and may be any form of electrode section as long as it forms an electric field between itself and the head 21 (nozzles #1 to #180).

<Regarding Ejection Inspection>

In the foregoing embodiments, ejection inspection was performed for each nozzle separately, but the ejection inspection of the present invention may be carried out by simultaneously ejecting ink from a plurality of nozzles and performing ejection inspection for two or more nozzles simultaneously. In this case, it is possible to examine the presence/absence of ejection for each nozzle individually based on, for example, the difference between the intensity of the induced current produced in the sensing sections 70, 104, 114, 116, 200, and 210 when ink is ejected properly from two or more nozzles and the intensity of the induced current produced in the sensing sections 70, 104, 114, 116, 200, and 210 when there is a nozzle with an ejection failure.

<Regarding the Apparatus for Inspecting Liquid Ejection>

In the foregoing embodiments, an apparatus for inspecting liquid ejection provided in a liquid ejecting apparatus, an example of which was an inkjet printer, was described as an example of an apparatus for inspecting liquid ejection, but the apparatus for inspecting liquid ejection according to the present invention is not limited to such an apparatus, and may be isolated from the liquid ejecting apparatus as an apparatus capable of independently executing only ejection inspection of a liquid, and may be an apparatus for inspecting liquid ejection that is installed on other apparatuses apart from the above-described liquid ejecting apparatus.

<Regarding the Liquid Ejecting Apparatus>

In the foregoing embodiments, an inkjet printer was described as an example of an apparatus for inspecting liquid ejection, but the liquid ejecting apparatus of the present invention is not limited to an inkjet printer, and it may be any type of apparatus, as long as it is an apparatus that ejects a liquid.

What is claimed is:

1. A method for inspecting liquid ejection comprising:

a step of ejecting an electrically-charged liquid from a nozzle subjected to ejection inspection so that said liquid contacts a sensing section provided in a state of non-contact to said nozzle, said liquid being electrically charged by applying a voltage to said sensing section; and a step of determining that the liquid has been ejected if a current is produced by said liquid ejected from said nozzle in said sensing section, and determining that the liquid has not been ejected if said current is not produced in said sensing section.

2. A method for inspecting liquid ejection according to claim 1, wherein a liquid droplet is ejected as said liquid from said nozzle subjected to ejection inspection.

3. A method for inspecting liquid ejection according to claim 1, wherein said current produced in said sensing section is detected.

4. A method for inspecting liquid ejection according to claim 3, wherein a determination of whether or not said current has been produced in said sensing section is carried out by comparing a current level of said current that has been detected and a predetermined reference level.

5. A method for inspecting liquid ejection according to claim 1, wherein said liquid ejected from said nozzle is electrically charged by frictional electrification.

6. A method for inspecting liquid ejection according to claim 1, wherein said liquid ejected from said nozzle is electrically charged by an electrode section to which a voltage is applied.

7. A method for inspecting liquid ejection according to claim 1, wherein said sensing section is made of a wire material.

8. A method for inspecting liquid ejection according to claim 1, wherein said sensing section is formed in a coil shape.

9. A method for inspecting liquid ejection according to claim 1, wherein said liquid ejected from said nozzle is ink.

10. A method for inspecting liquid ejection comprising:

a step of ejecting an electrically-charged liquid from a nozzle subjected to ejection inspection; and a step of determining that the liquid has been ejected if an induced current is produced by said liquid ejected from said nozzle in a sensing section provided in a state of non-contact to said nozzle, and determining that the liquid has not been ejected if said induced current is not produced in said sensing section;

wherein a water repellent treatment is applied to a surface of said sensing section.

11. An apparatus for inspecting liquid ejection, comprising:

a sensing section provided in a state of non-contact to a nozzle subjected to ejection inspection; and a determination section for determining whether or not a liquid has been ejected from said nozzle, said determination section determining that the liquid has been ejected if a current is produced in said sensing section by said liquid, that has been ejected from said nozzle and that has been electrically charged, said liquid contacting said sensing section, and determining that the liquid has not been ejected if said current is not produced in said sensing section.

12. A liquid ejecting apparatus, comprising:

a nozzle that ejects a liquid to a medium so that said liquid contacts a sensing section;

the sensing section provided in a state of non-contact to said nozzle; and a determination section for determining whether or not said liquid has been ejected from said nozzle, said determination section determining that the liquid has been ejected if current is produced in said sensing section by said liquid that has been ejected from said nozzle and that has been electrically charged, and determining that the liquid has not been ejected if said current is not produced in said sensing section.

13. A method for inspecting liquid ejection comprising:

a step of ejecting an electrically-charged liquid from a nozzle subjected to ejection inspection so that said liquid contacts a sensing section provided in a state of non-contact to said nozzle; and a step of detecting an intensity of a current produced by said liquid ejected from said nozzle in a sensing section, and determining whether or not an ejection direction of said liquid is proper based on said intensity of said current that has been detected.

14. A method for inspecting liquid ejection according to claim 13, wherein a liquid droplet is ejected as said liquid from said nozzle subjected to ejection inspection.

15. A method for inspecting liquid ejection according to claim 13, wherein said liquid ejected from said nozzle is electrically charged by frictional electrification.

16. A method for inspecting liquid ejection according to claim 13, wherein said liquid ejected from said nozzle is electrically charged by an electrode section to which a voltage is applied.

17. A method for inspecting liquid ejection according to claim 13, wherein a determination is made as to whether or not the ejection direction of said liquid is proper by comparing the intensity of said current that has been detected and a predetermined threshold value.

18. A method for inspecting liquid ejection according to claim 13, wherein said sensing section is made of a wire material.

19. A method for inspecting liquid ejection according to claim 13, wherein said liquid ejected from said nozzle is ink.

20. A method for inspecting liquid ejection comprising:

a step of ejecting an electrically-charged liquid from a nozzle subjected to ejection inspection so that said liquid contacts a sensing section provided in a state of non-contact to said nozzle; and a step of detecting an intensity of a current produced by said liquid ejected from said nozzle in a sensing section, and determining whether or not an ejection direction of said liquid is proper based on said intensity of said current that has been detected;

wherein said sensing section is made of a wire material; and wherein said nozzle is provided so as to be able to move relatively with respect to said sensing section; and wherein said wire material is arranged obliquely with respect to a movement direction of said nozzle.

21. A method for inspecting liquid ejection comprising:

a step of ejecting an electrically-charged liquid from a nozzle subjected to ejection inspection so that said liquid contacts a sensing section provided in a state of non-contact to said nozzle; and a step of detecting an intensity of a current produced by said liquid ejected from said nozzle in a sensing section, and determining whether or not an ejection direction of said liquid is proper based on said intensity of said current that has been detected;

wherein said sensing section is made of at least two wires; and wherein the at least two wires are arranged in a non-parallel arrangement.

22. A method for inspecting liquid ejection according to claim 21, wherein an intensity of said current produced in each of said wires is detected separately, and a determination as to whether or not the ejection direction of said liquid is proper is made based on each of the current intensity that has been detected.

23. An apparatus for inspecting liquid ejection, comprising:

a sensing section provided in a state of non-contact to a nozzle subjected to ejection inspection; and a determination section for determining whether or not an ejection direction of a liquid that has been ejected from said nozzle is proper, said determination section detecting an intensity of a current produced in said sensing section by said liquid that has been ejected from said nozzle, said liquid contacting said sensing section, and that has been electrically charged, and determining whether or not the ejection direction of said liquid is proper based on said intensity of said current that has been detected.

24. A liquid ejecting apparatus, comprising:

a nozzle that ejects a liquid to a medium so that said liquid contacts a sensing section;

the sensing section provided in a state of non-contact to said nozzle; and a determination section for determining whether or not an ejection direction of said liquid from said nozzle is proper, said determination section detecting an intensity of a current produced in said sensing section by said liquid that has been ejected from said nozzle and that has been electrically charged, and determining whether or not the ejection direction of said liquid is proper based on said intensity of said current that has been detected.

* * * * *